US010173427B2

(12) United States Patent
Shirota et al.

(10) Patent No.: US 10,173,427 B2
(45) Date of Patent: Jan. 8, 2019

(54) RECORDING APPARATUS

(71) Applicant: SEIKO EPSON CORPORATION, Tokyo (JP)

(72) Inventors: Kenichi Shirota, Suwa (JP); Atsuhiko Takeuchi, Matsumoto (JP); Kazunori Takabayashi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/441,096

(22) Filed: Feb. 23, 2017

(65) Prior Publication Data

US 2017/0246869 A1 Aug. 31, 2017

(30) Foreign Application Priority Data

Feb. 26, 2016 (JP) ..... 2016-035220

(51) Int. Cl.

| | |
|---|---|
| ***B41J 19/30*** | (2006.01) |
| ***B41J 23/00*** | (2006.01) |
| ***B41J 23/02*** | (2006.01) |
| ***B41J 2/165*** | (2006.01) |
| ***B41J 25/00*** | (2006.01) |
| ***B41J 19/20*** | (2006.01) |

(52) U.S. Cl.

CPC ..... *B41J 2/16505* (2013.01); *B41J 2/16517* (2013.01); *B41J 19/202* (2013.01); *B41J 19/305* (2013.01); *B41J 23/00* (2013.01); *B41J 23/02* (2013.01); *B41J 23/025* (2013.01); *B41J 25/001* (2013.01)

(58) Field of Classification Search

CPC ..... B41J 2/16505; B41J 19/305; B41J 23/00; B41J 23/02; B41J 23/025; B41J 25/001

See application file for complete search history.

(56) References Cited

U.S. PATENT DOCUMENTS

| | | | | |
|---|---|---|---|---|
| 5,475,404 | A * | 12/1995 | Takahashi | B41J 2/1652 347/23 |
| 5,552,902 | A * | 9/1996 | Kohno | H04N 1/0057 347/3 |
| 6,559,977 | B2 * | 5/2003 | Sasai | H04N 1/00538 358/400 |
| 7,404,614 | B2 * | 7/2008 | Usuda | B41J 2/16579 347/19 |
| 9,139,028 | B1 * | 9/2015 | Otsuka | B41J 11/0035 |
| 9,180,696 | B2 * | 11/2015 | Togo | B41J 13/0009 |
| 2014/0009550 | A1 | 1/2014 | Togo et al. | |

FOREIGN PATENT DOCUMENTS

| | | |
|---|---|---|
| CN | 204196451 | 3/2015 |
| JP | 2014-014943 | 1/2014 |
| JP | 2014034182 | 2/2014 |

* cited by examiner

*Primary Examiner* — Anh T. N. Vo
(74) *Attorney, Agent, or Firm* — Workman Nydegger

(57) ABSTRACT

A recording apparatus includes a carriage which includes a recording head that performs recording on a medium and is movable in a predetermined direction; and a power supply unit that supplies power for driving drive targets including the carriage, wherein the power supply unit is located at a position in a movement area of the carriage. The power supply unit is disposed on an apparatus front side with respect to the movement area of the carriage in an apparatus depth direction, which is a direction intersecting the movement direction of the carriage. The power supply unit is disposed on an upper side of a medium transportation path in the vertical direction.

13 Claims, 19 Drawing Sheets

RECORDING APPARATUS

BACKGROUND

1. Technical Field

The present invention relates to recording apparatuses that perform recording onto a medium.

2. Related Art

JP-A-2014-014943 discloses a recording apparatus which includes a transferring unit that transports a medium, a mechanism unit which includes a recording unit that performs recording on the medium, and a main substrate on which electronics that control the mechanism unit are mounted, wherein the main substrate is disposed in a gap between a bottom of an apparatus main body and the mechanism unit in a mechanism components positioning area in which mechanism components that form the mechanism unit are positioned in the apparatus main body. Since the main substrate is disposed in the gap between the bottom of the apparatus main body and the mechanism unit in the mechanism components positioning area, the apparatus is reduced in size compared with the configuration in which the main substrate is disposed outside the mechanism components positioning area.

In addition to the main substrate, a power supply unit (regulator) that supplies power to the main substrate and a drive power source such as a motor is disposed in the recording apparatus. Since the power supply unit requires a large installation space in the recording apparatus, the apparatus dimension is largely affected. In the conventional recording apparatus, since an inlet that allows the power supply plug is inserted and removed is disposed on the back side of the apparatus close to the side surface of the apparatus, the power supply unit is also disposed at the same position (see JP-A-2014-014943).

SUMMARY

Therefore, the conventional recording apparatus has a problem that the size of the apparatus is increased due to the positioning of the power supply unit. Accordingly, an advantage of some aspects of the invention is that the apparatus which is reduced in size by appropriately positioning the power supply unit is provided.

According to a first aspect of the present invention, a recording apparatus includes: a carriage which includes a recording head that performs recording on a medium and is movable in a predetermined direction; and a power supply unit that supplies power for driving drive targets including the carriage, wherein the power supply unit is located at a position in a movement area of the carriage.

According to this aspect, since the position of the power supply unit that supplies power for driving drive targets including the carriage is in the movement area of the carriage, the apparatus dimension can be reduced in the movement direction of the carriage.

According to a second aspect of the present invention, the power supply unit is disposed on an apparatus front side with respect to the movement area of the carriage in an apparatus depth direction, which is a direction intersecting a movement direction of the carriage.

According to this aspect, since the power supply unit is disposed on an apparatus front side with respect to the movement area of the carriage in an apparatus depth direction, which is a direction intersecting a movement direction of the carriage, a space on the apparatus front side with respect to the movement area of the carriage can be effectively used, thereby reducing the apparatus depth dimension.

According to a third aspect of the present invention, the power supply unit is disposed on an upper side of a transportation path of a medium in the vertical direction.

According to this aspect, since the power supply unit is disposed on the upper side of the transportation path of a medium in the vertical direction, a region above the medium transportation path, which is likely to form a large vacant space can be effectively used, thereby reducing the apparatus dimension in the vertical direction. In addition, a maintenance operation of the power supply unit can be easily performed.

According to a fourth aspect of the present invention, at least a portion of the power supply unit overlaps the movement area of the carriage in the vertical direction.

According to this aspect, since at least a portion of the power supply unit overlaps the movement area of the carriage in the vertical direction, an installation space of the carriage and an installation space of the power supply unit are not completely superposed in the vertical direction, thereby reducing the apparatus dimension in the vertical direction.

According to a fifth aspect of the present invention, the recording apparatus further includes an operation section for input operation disposed on the apparatus front side in the apparatus depth direction, which is a direction intersecting the movement direction of the carriage, wherein the power supply unit is disposed between the movement area of the carriage and the operation section in the apparatus depth direction.

According to this aspect, since the operation section for an input operation is disposed on the apparatus front side in the apparatus depth direction, which is a direction intersecting the movement direction of the carriage, and the power supply unit is disposed between the movement area of the carriage and the operation section in the apparatus depth direction. Accordingly, a space between the operation section and the movement area can be effectively used, thereby reducing the apparatus depth dimension.

According to a sixth aspect of the present invention, the recording apparatus further includes a cap that seals the recording head; and a liquid flow path that guides liquid, which is ejected into the cap from the recording head, to a liquid storage, wherein the power supply unit is disposed on an upper side of the liquid flow path in the vertical direction.

According to a seventh aspect of the present invention, the recording apparatus further includes an inlet for connecting a power supply plug on an apparatus back side in the apparatus depth direction, which is a direction that intersects the movement direction of the carriage, wherein at least a portion of the cable that connects the inlet and the power supply unit is disposed with a wall interposed between the at least a portion of the cable and at least a portion of the liquid flow path.

According to an eighth aspect of the present invention, a wall is disposed between the power supply unit and the movement area of the carriage.

According to a ninth aspect of the present invention, a recording apparatus includes: a carriage which includes a recording head that performs recording on a medium and is movable in a predetermined direction; and a power supply unit that supplies power for driving drive targets including the carriage, wherein the power supply unit is located at an apparatus front side with respect to a movement area of the carriage in an apparatus depth direction, which is a direction intersecting a movement direction of the carriage.

According to this aspect, since the power supply unit that supplies power for driving drive targets including the carriage is located at the apparatus front side with respect to the movement area of the carriage in the apparatus depth direction, which is a direction intersecting the movement direction of the carriage, a space on the apparatus front side with respect to the movement area of the carriage can be effectively used, thereby reducing the apparatus depth dimension.

According to a tenth aspect of the present invention, a recording apparatus includes: a recording head that performs recording on a medium; and a power supply unit that supplies power for driving drive targets including the recording head, wherein the power supply unit is located at an upper side of a transportation path of a medium in the vertical direction.

According to this aspect, since the power supply unit that supplies power for driving drive targets including the recording head is located at the upper side of the transportation path of a medium in the vertical direction, a region above the medium transportation path, which is likely to form a large vacant space can be effectively used, thereby reducing the apparatus dimension in the vertical direction. In addition, a maintenance operation of the power supply unit can be easily performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of the present invention will be described. Throughout the embodiments, the same components are denoted by the same reference signs and the description thereof is made only in the embodiment in which the component first appears to avoid duplication of description in the subsequent embodiments.

Figure 1:
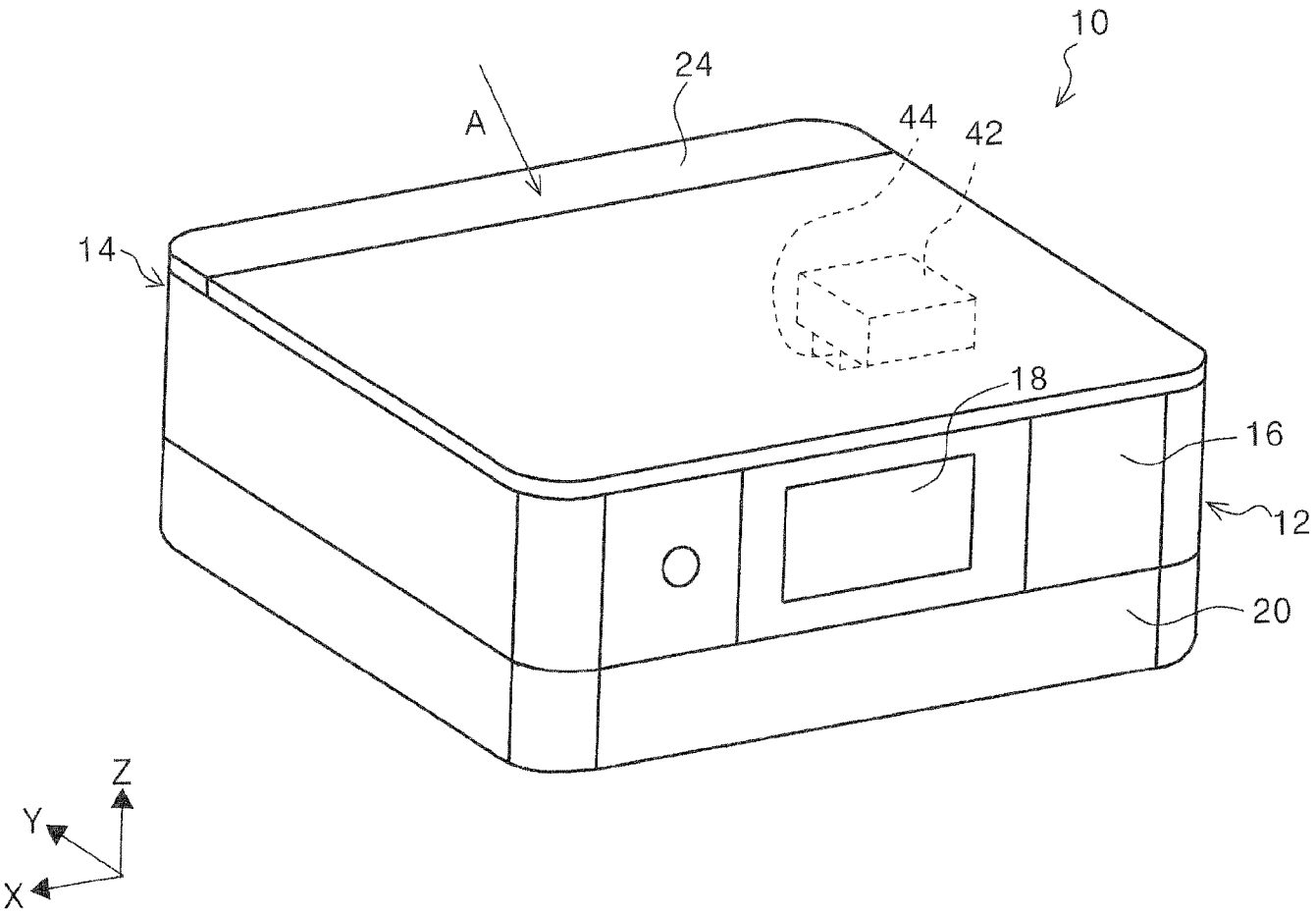
FIG. 1 is an outer appearance perspective view of a printer according to the present invention.
Figure 2:
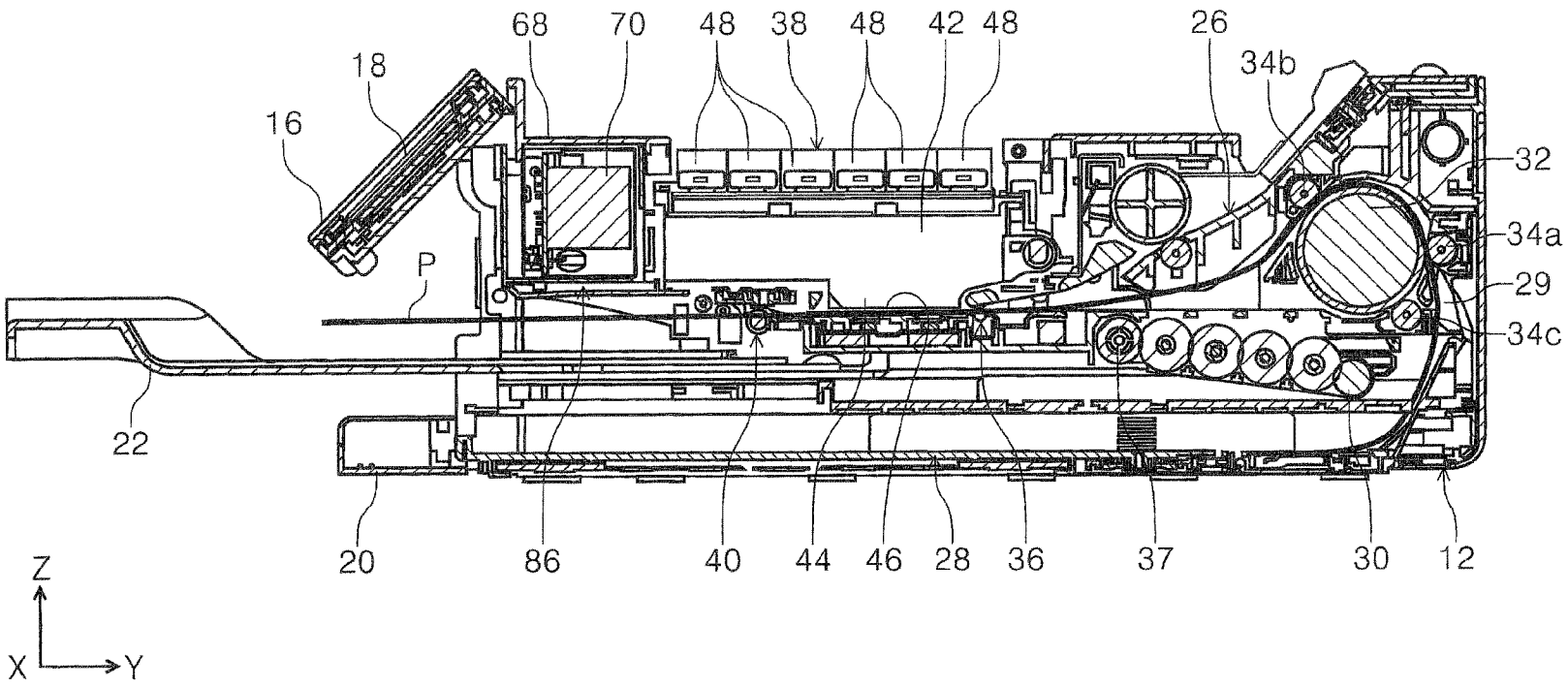
FIG. 2 is a side sectional view of a medium transportation path of the printer according to the present invention.
Figure 3:
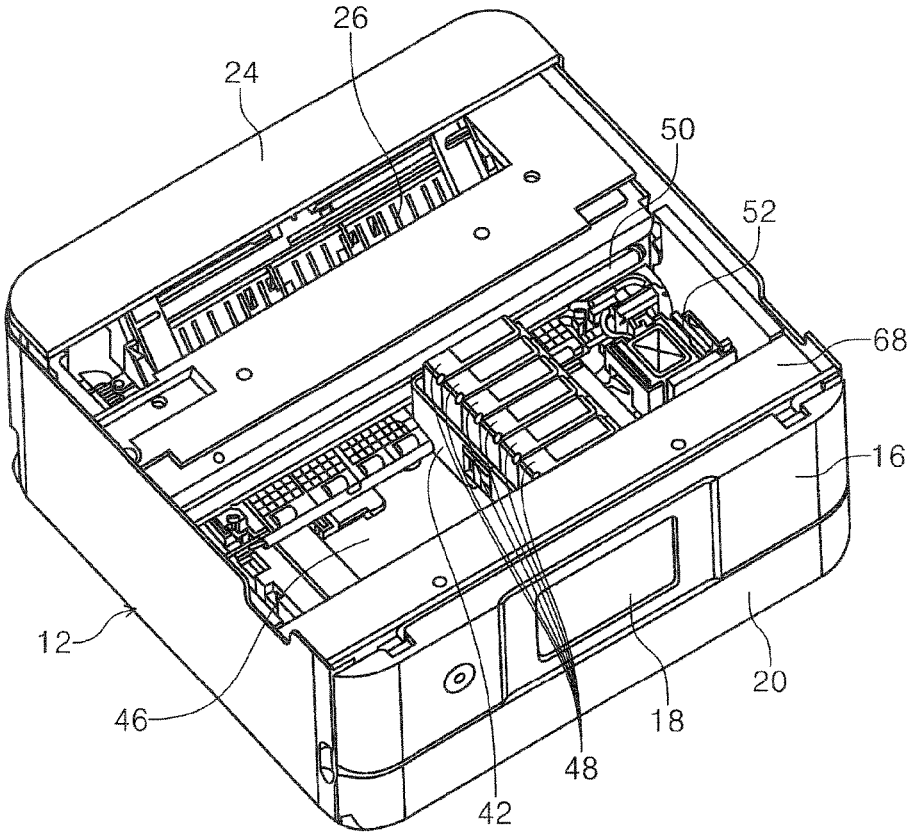
FIG. 3 is a perspective view of a carriage and a cap unit of the printer according to the present invention.
Figure 3:
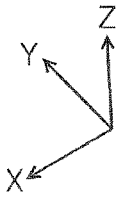
Figure 4:
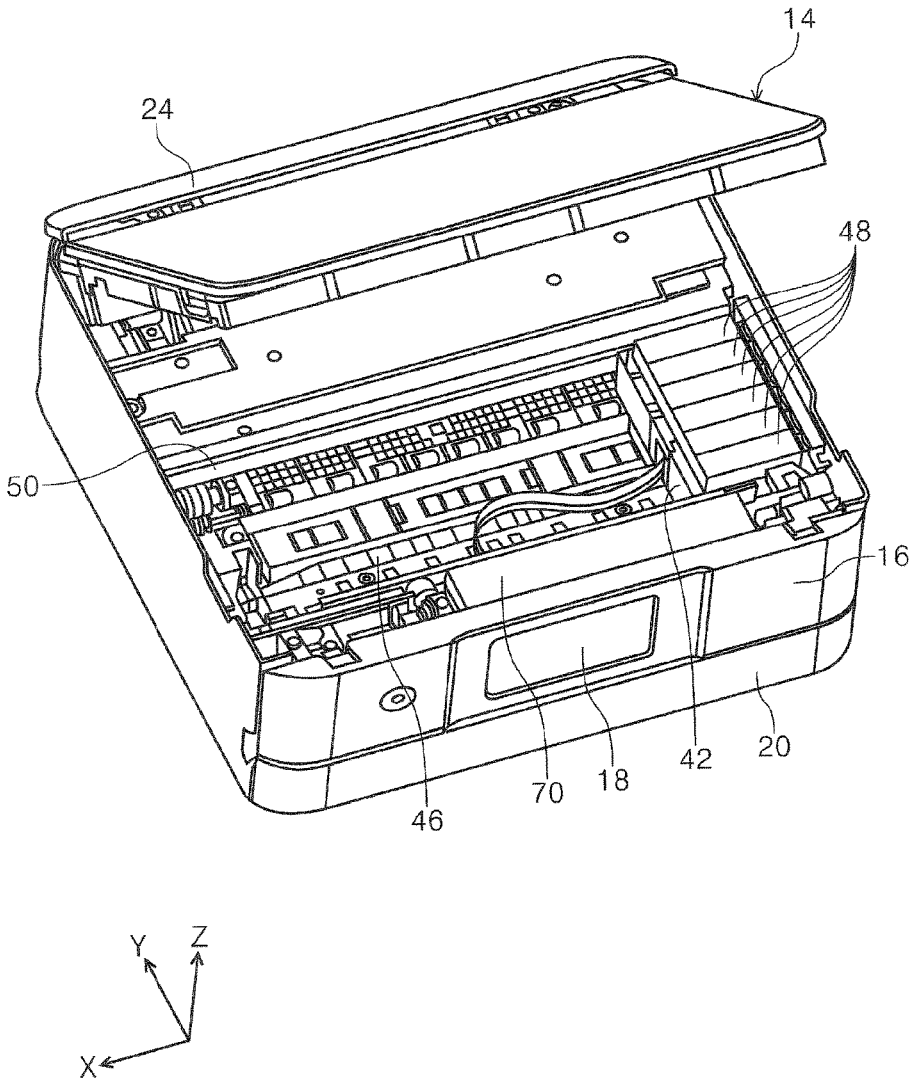
FIG. 4 is a perspective view of a power supply unit of the printer according to the present invention.
Figure 5:
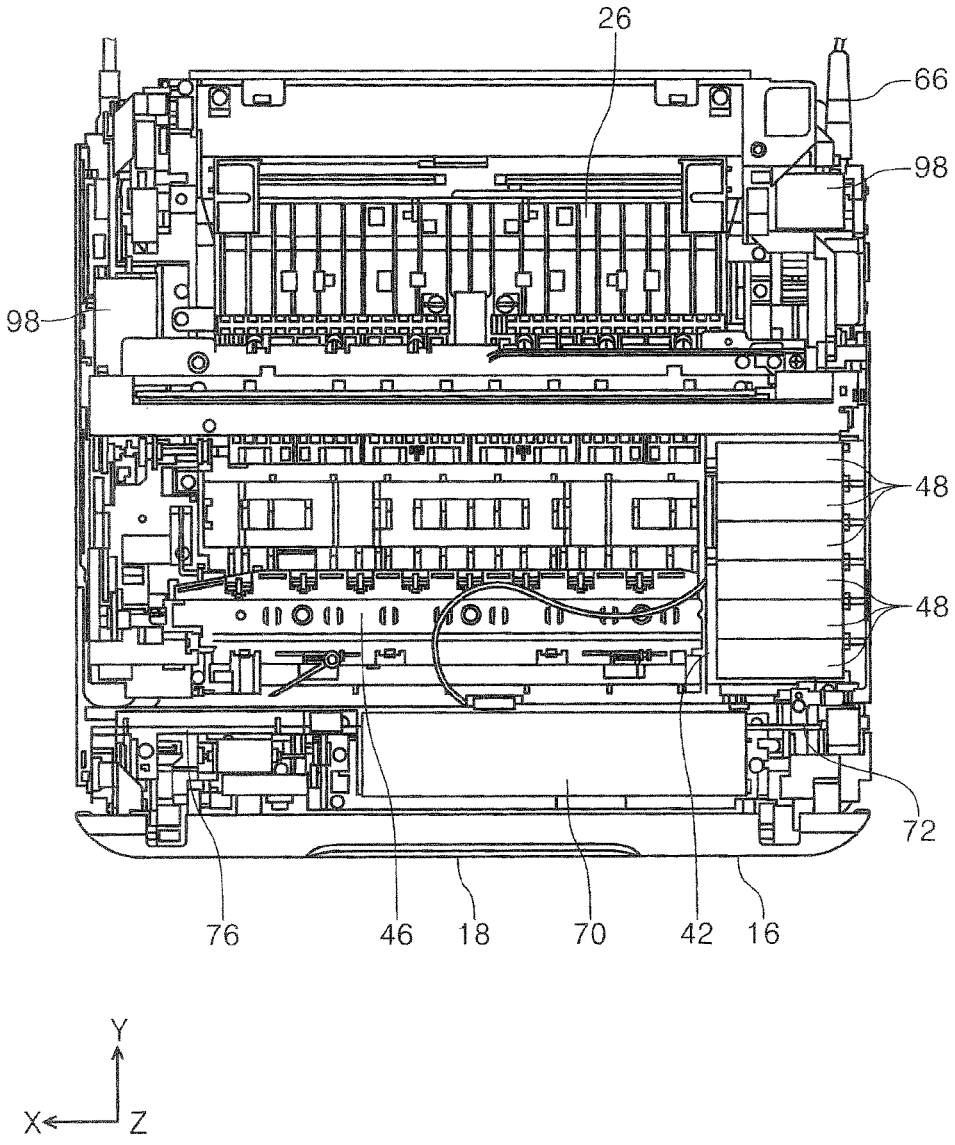
FIG. 5 is a plan view of an apparatus main body of the printer according to the present invention.
Figure 6:
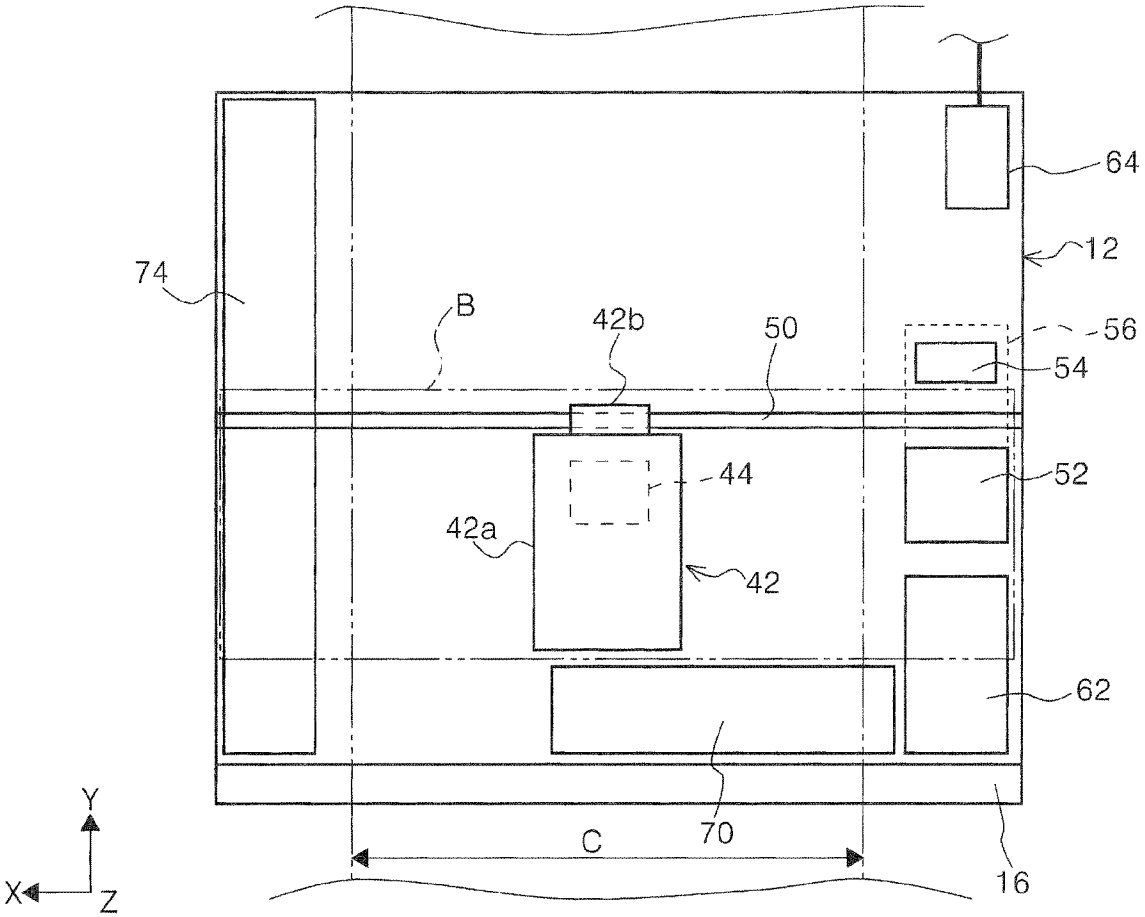
FIG. 6 is a schematic diagram which shows a layout of components of the apparatus main body of FIG. 5.

FIG. 1 is an outer appearance perspective view of a printer according to the present invention, FIG. 2 is a side sectional view of a medium transportation path of the printer according to the present invention, FIG. 3 is a perspective view of a carriage and a cap unit of the printer according to the present invention, FIG. 4 is a perspective view of a power supply unit of the printer according to the present invention, FIG. 5 is a plan view of an apparatus main body of the printer according to the present invention, and FIG. 6 is a schematic diagram which shows a layout of components of the apparatus main body of FIG. 5.

Figure 7:
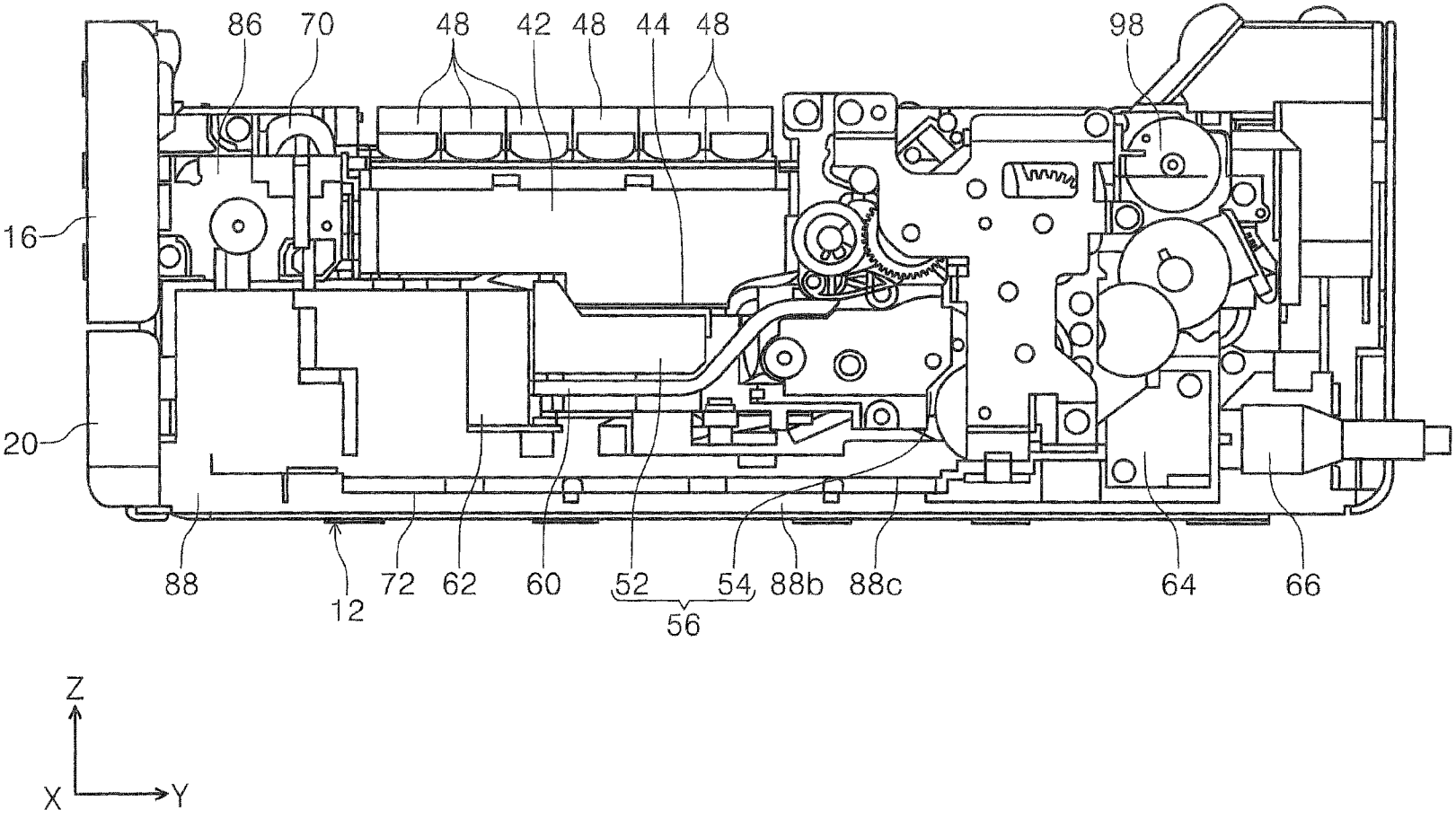
FIG. 7 is a side view of the apparatus main body of the printer according to the present invention.
Figure 8:
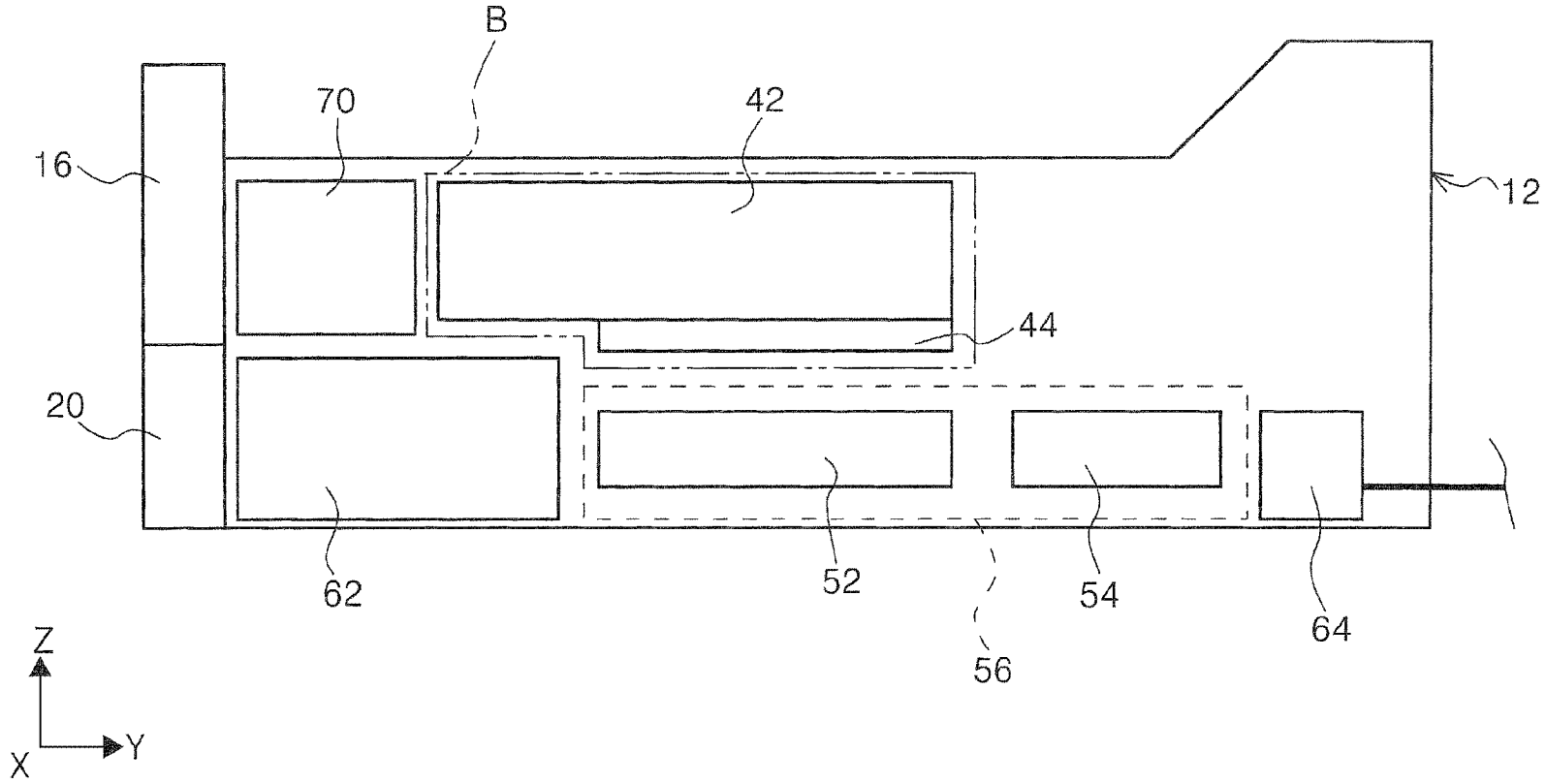
FIG. 8 is a schematic diagram which shows a layout of components of the apparatus main body of FIG. 7.
Figure 9:
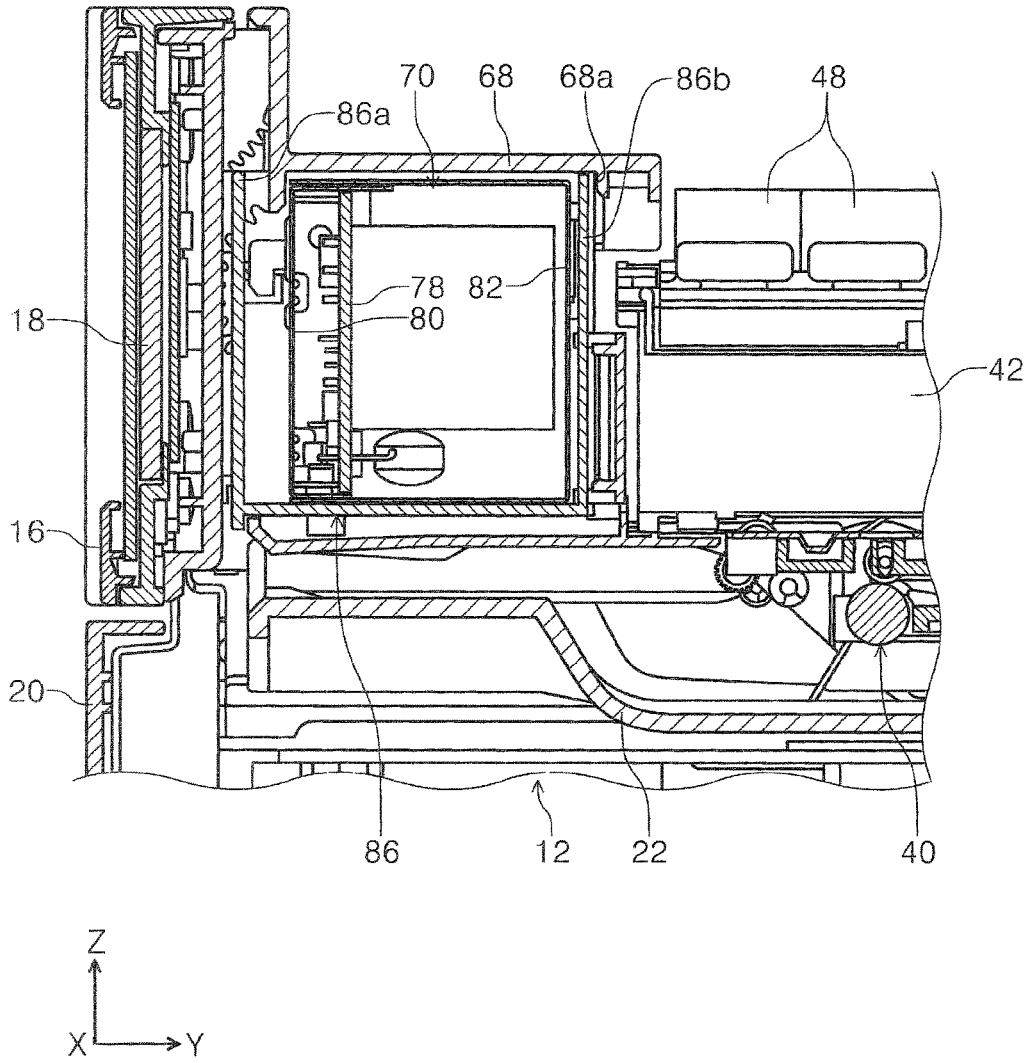
FIG. 9 is a side sectional view of the power supply unit of the present invention.
Figure 10:
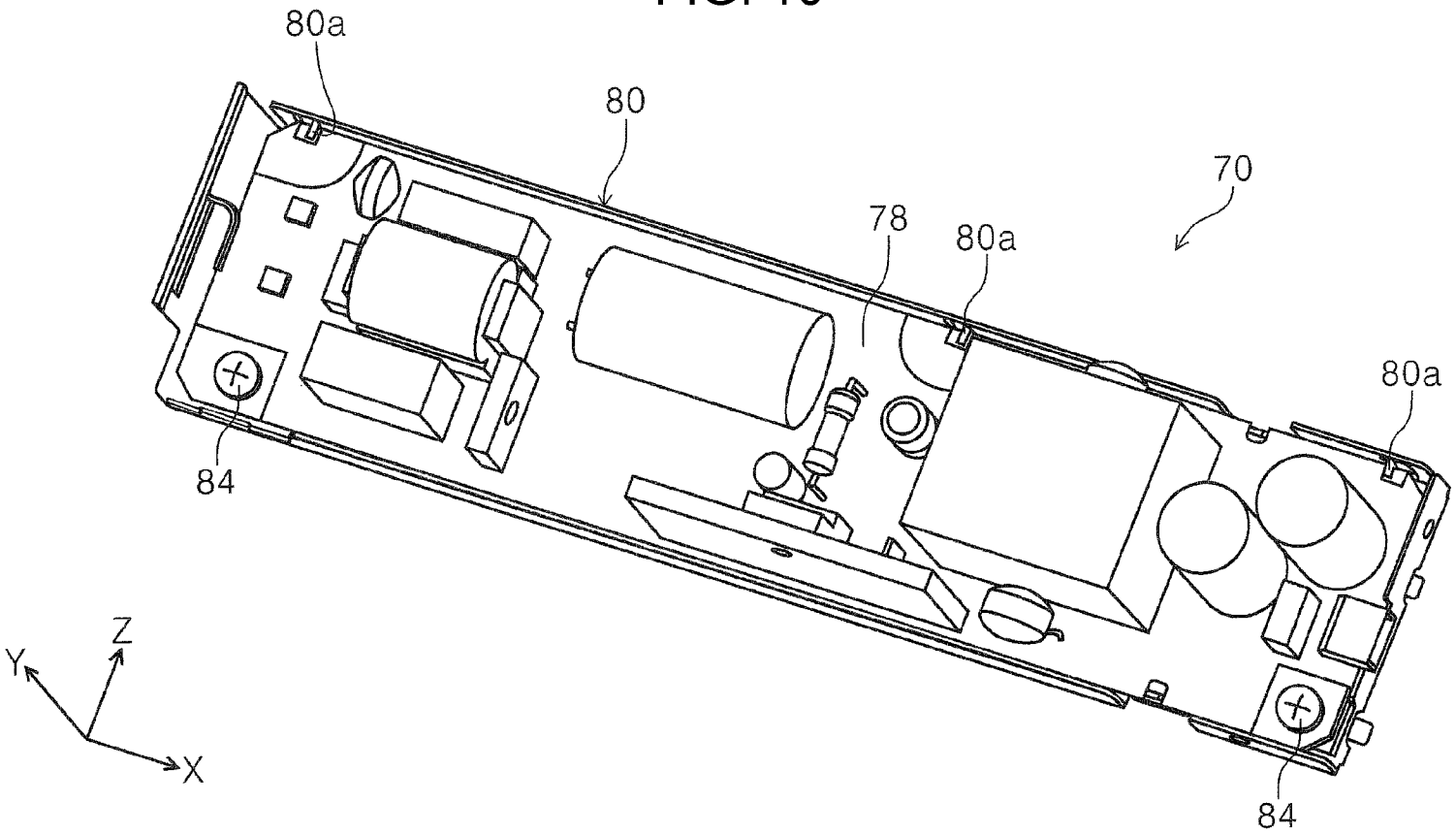
FIG. 10 is a perspective view which shows the inside of the power supply unit according to the present invention.
Figure 11:
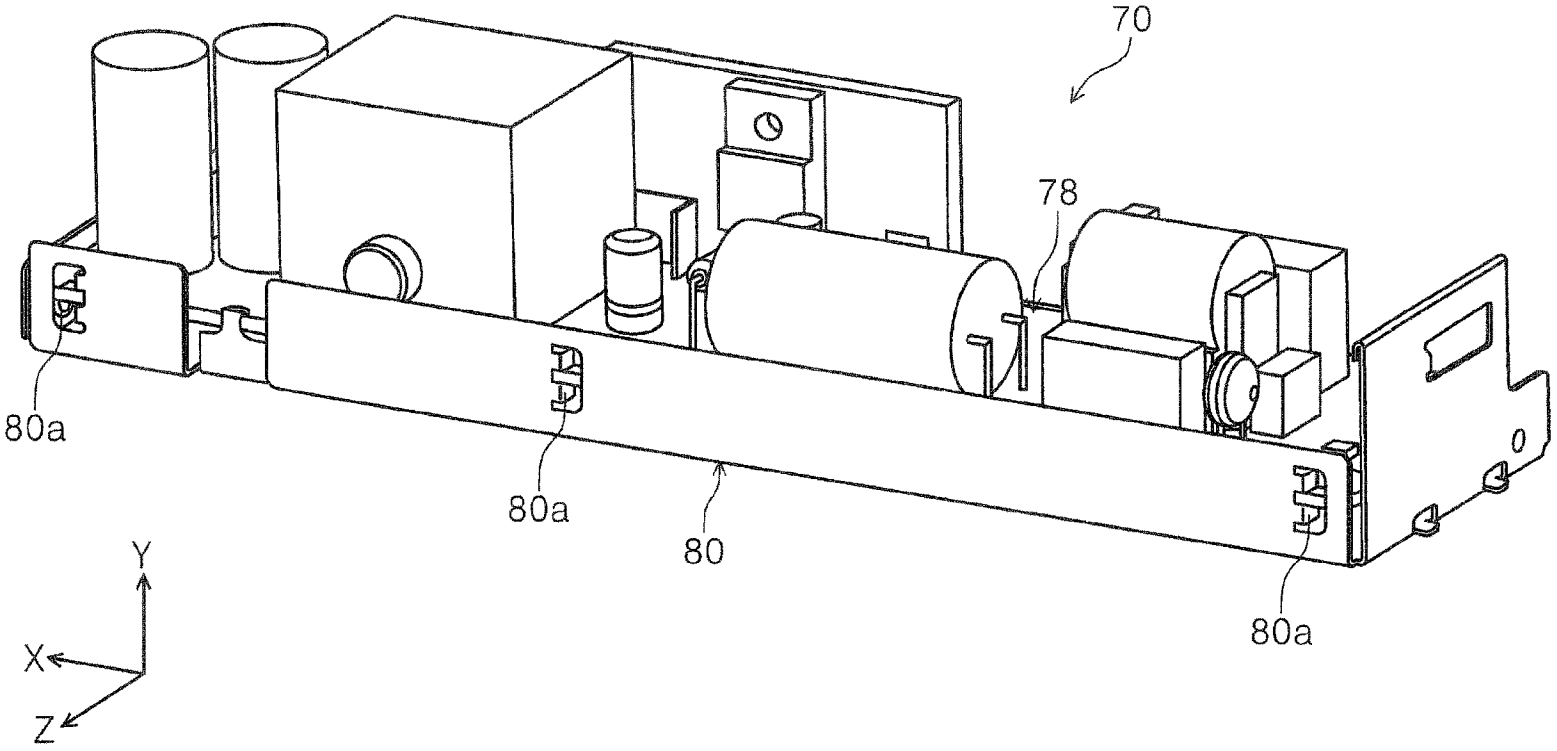
FIG. 11 is a perspective view which shows the inside of the power supply unit according to the present invention.
Figure 12:
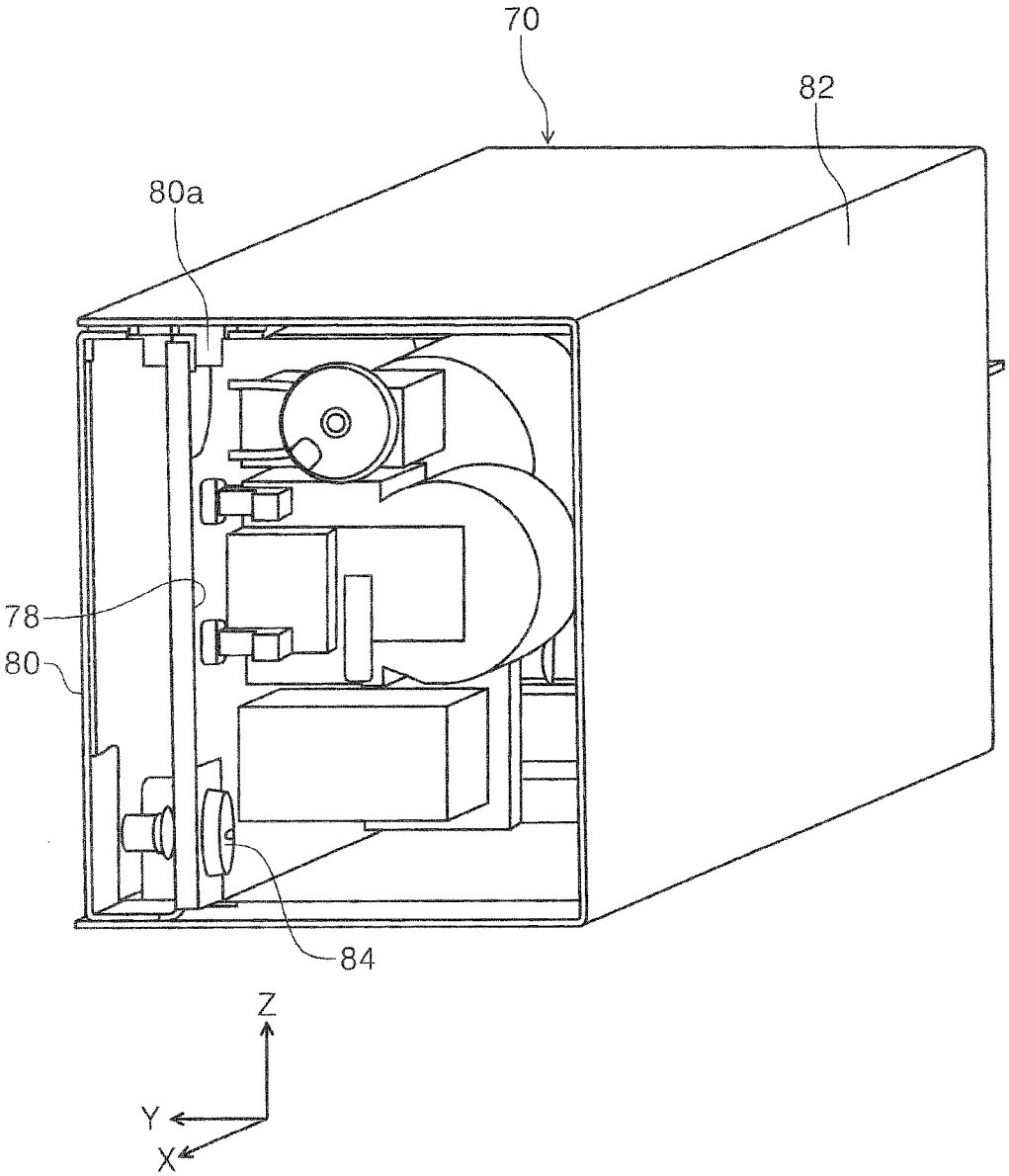
FIG. 12 is a perspective view which shows the inside of the power supply unit according to the present invention.

Further, FIG. 7 is a side view of the apparatus main body of the printer according to the present invention, FIG. 8 is a schematic diagram which shows a layout of components of the apparatus main body of FIG. 7, FIG. 9 is a side sectional view of the power supply unit of the present invention, FIG. 10 is a perspective view which shows the inside of the power supply unit according to the present invention, FIG. 11 is a perspective view which shows the inside of the power supply unit according to the present invention, and FIG. 12 is a perspective view which shows the inside of the power supply unit according to the present invention.

Figure 13:
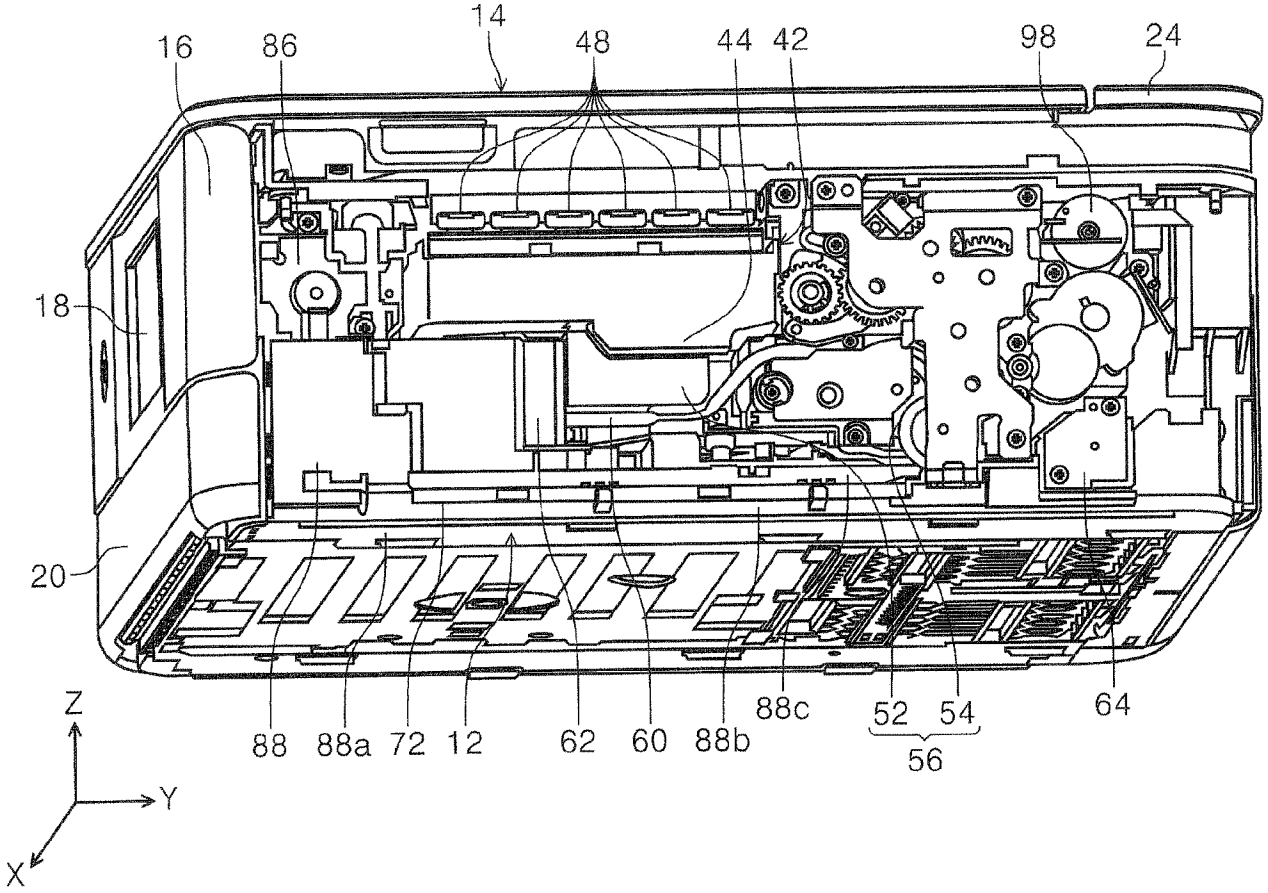
FIG. 13 is a perspective view which shows a path of a cable extending from the power supply unit to an inlet in the printer according to the present invention.
Figure 14:
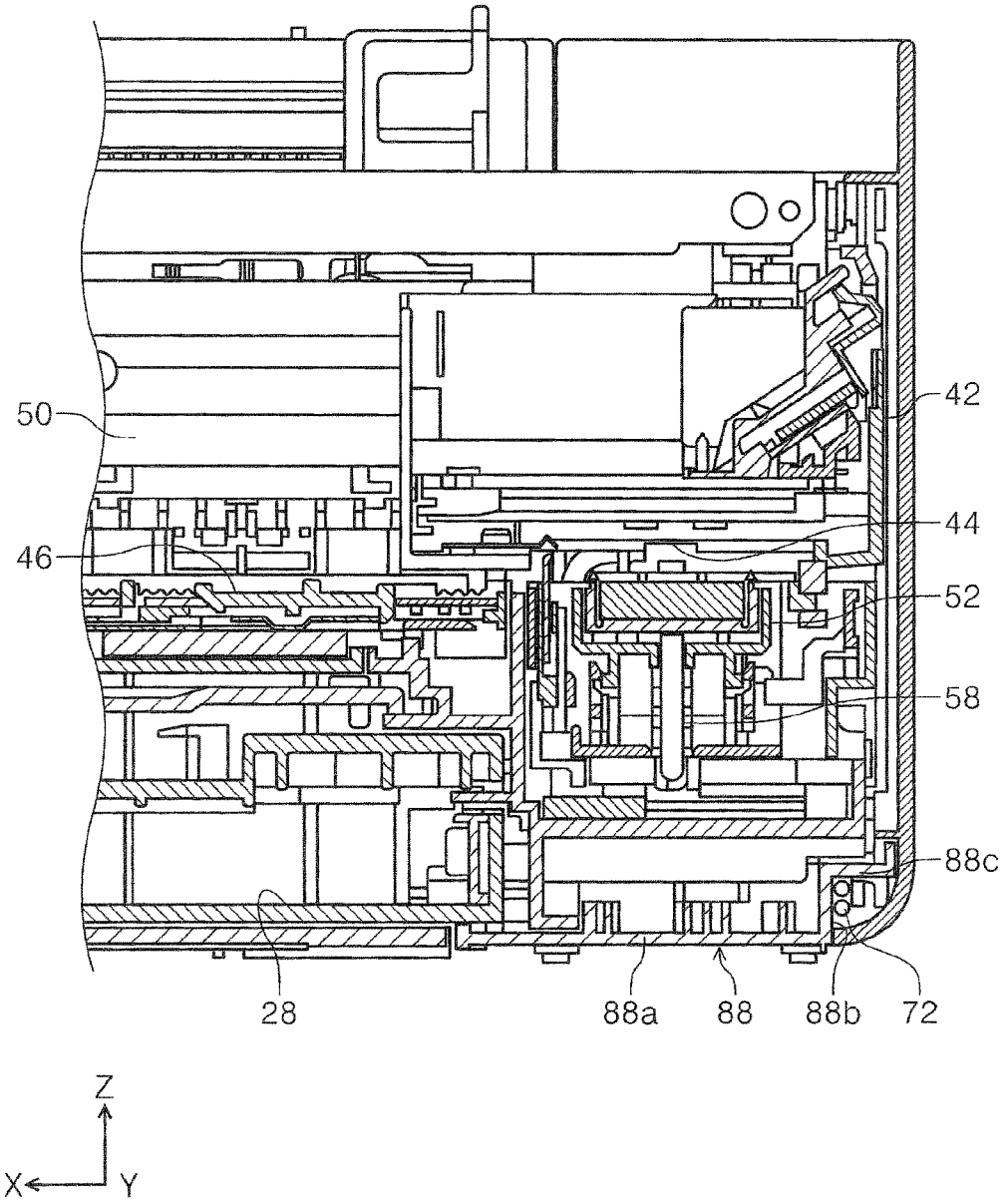
FIG. 14 is a sectional view which shows a relation between the cable extending from the power supply unit to the inlet and a cap.
Figure 15:
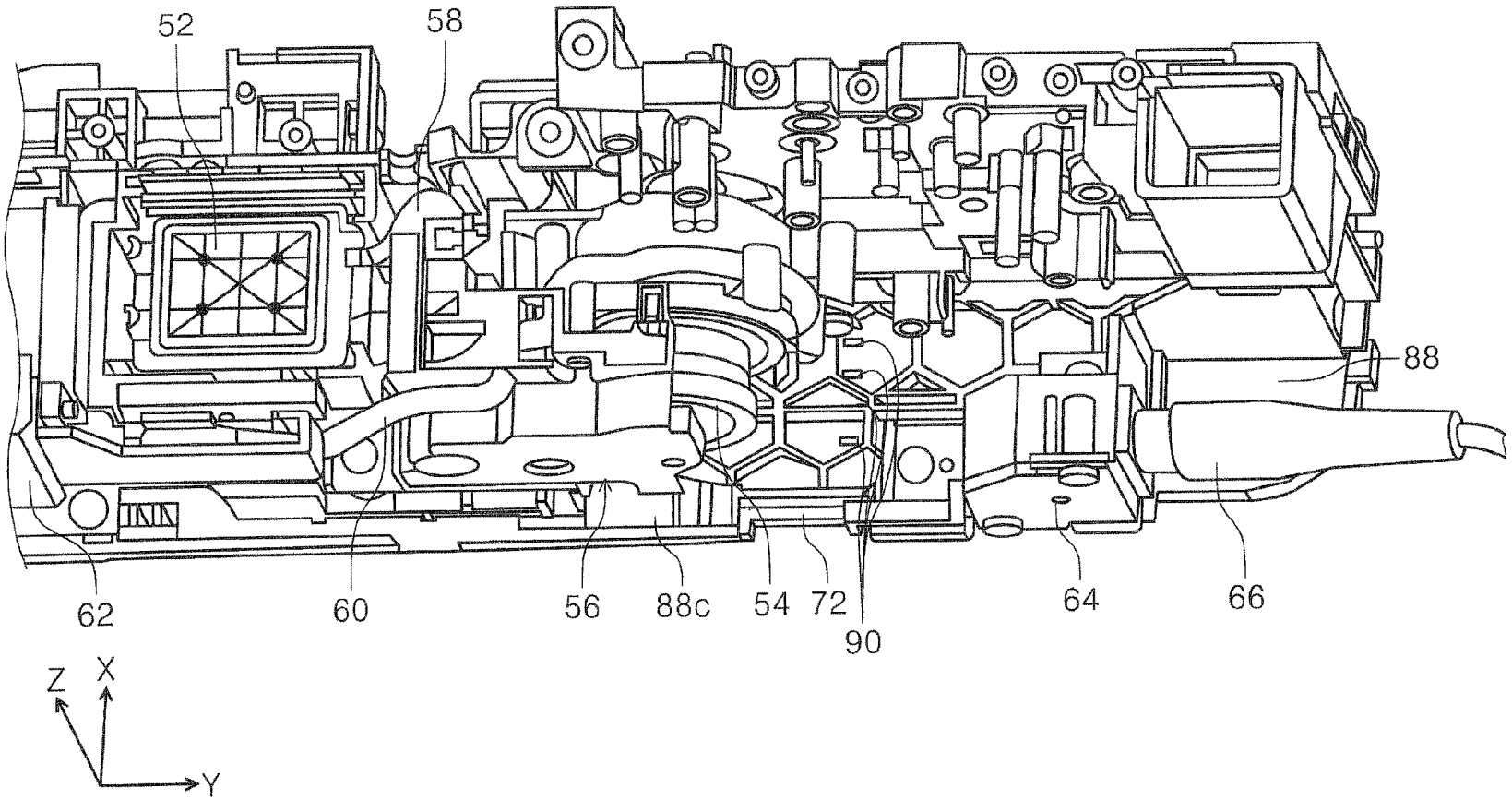
FIG. 15 is a perspective view which shows a relation among the cap, the inlet and the cable.
Figure 16:
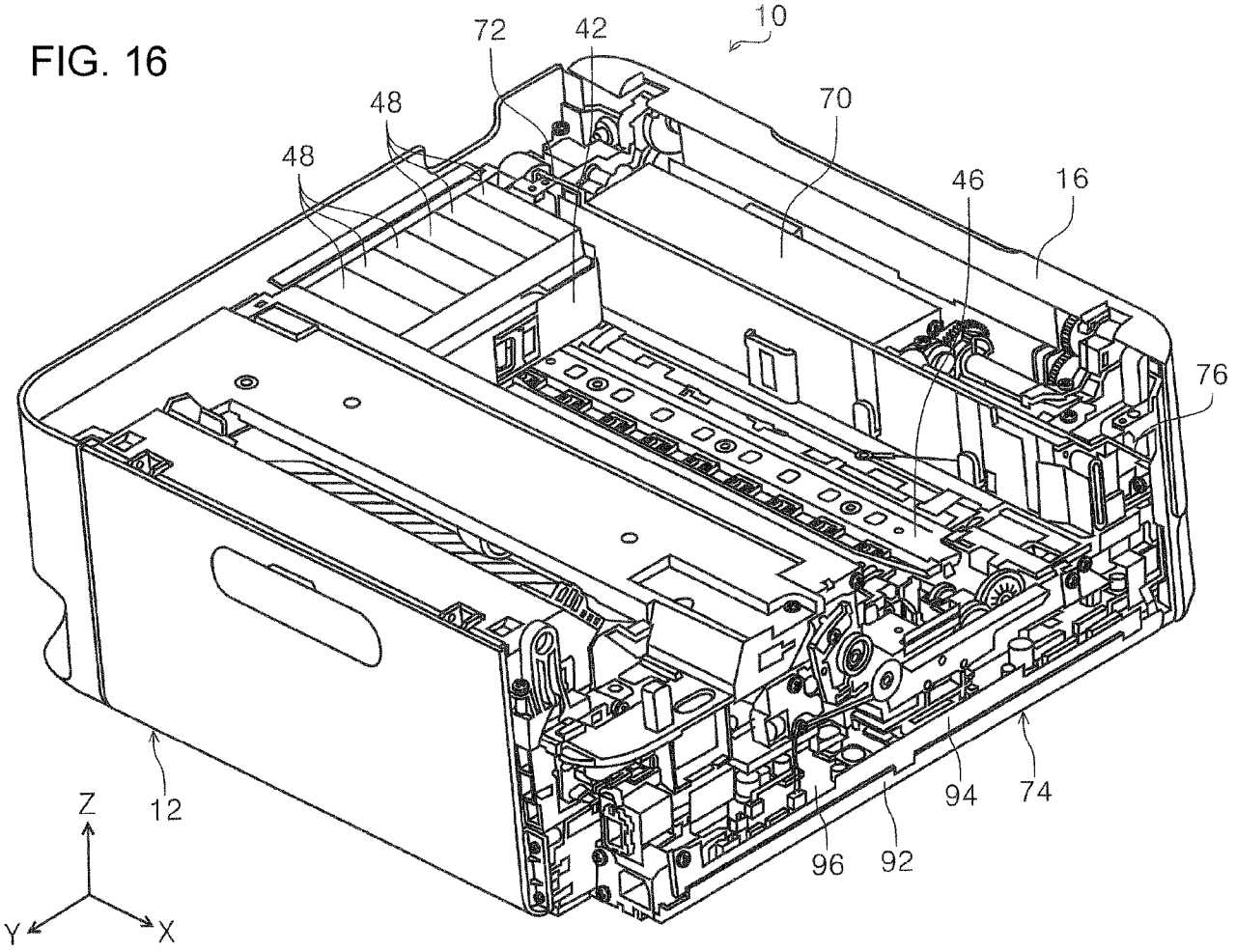
FIG. 16 is a perspective view which shows a path of the cable from the power supply unit to a control unit.
Figure 17:
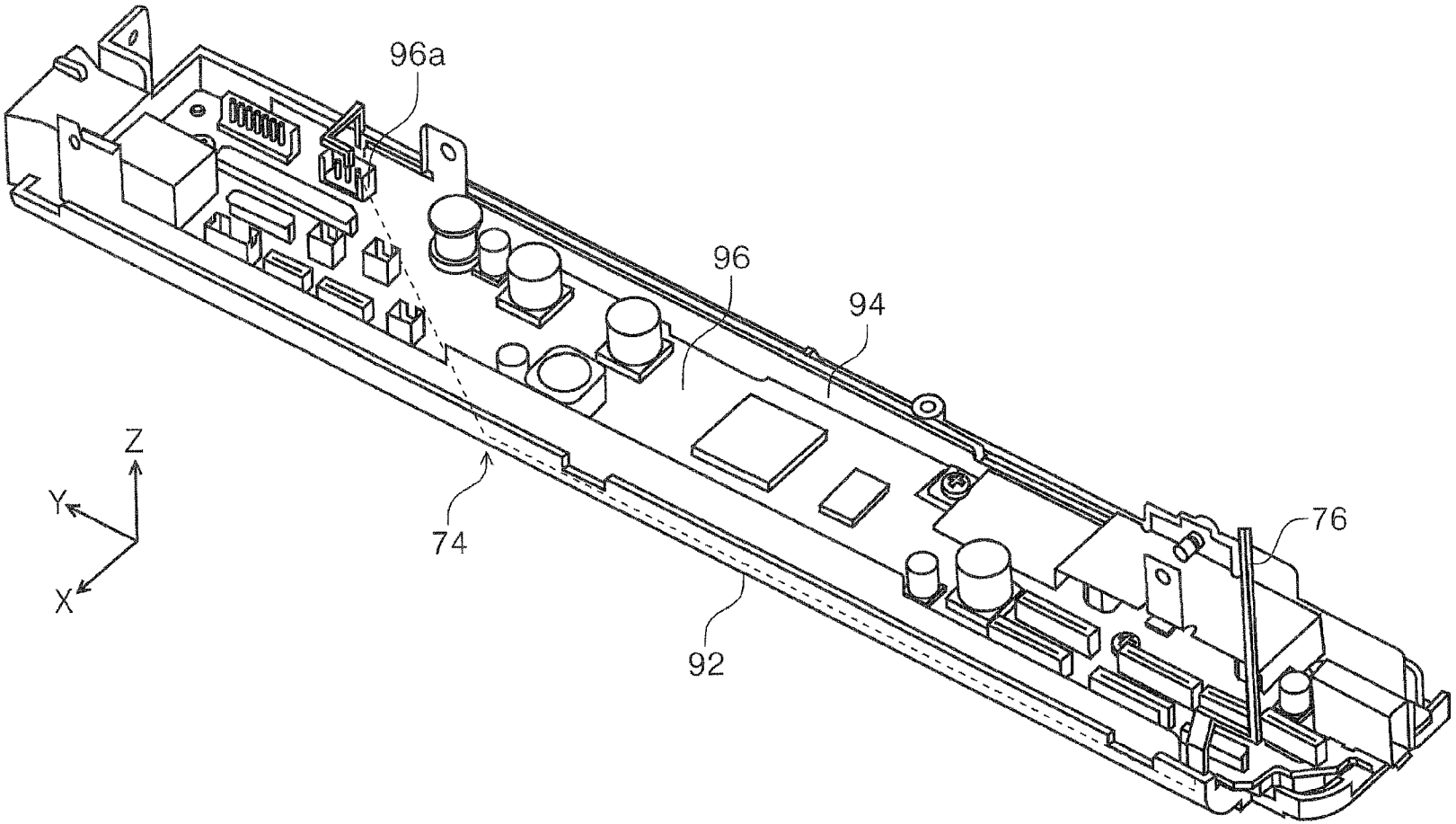
FIG. 17 is a perspective view of the control unit.
Figure 18:
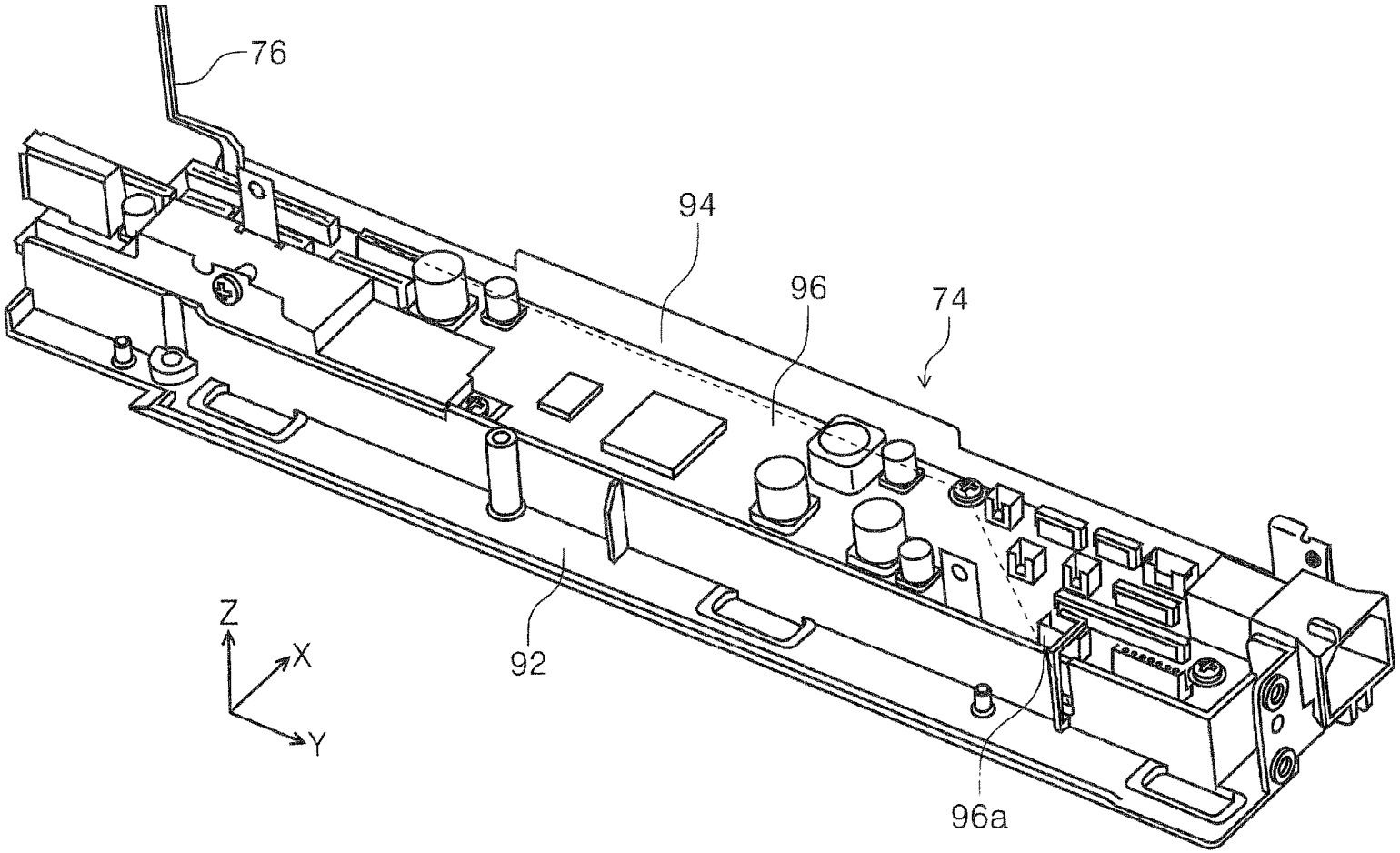
FIG. 18 is a perspective view of the control unit.
Figure 19:
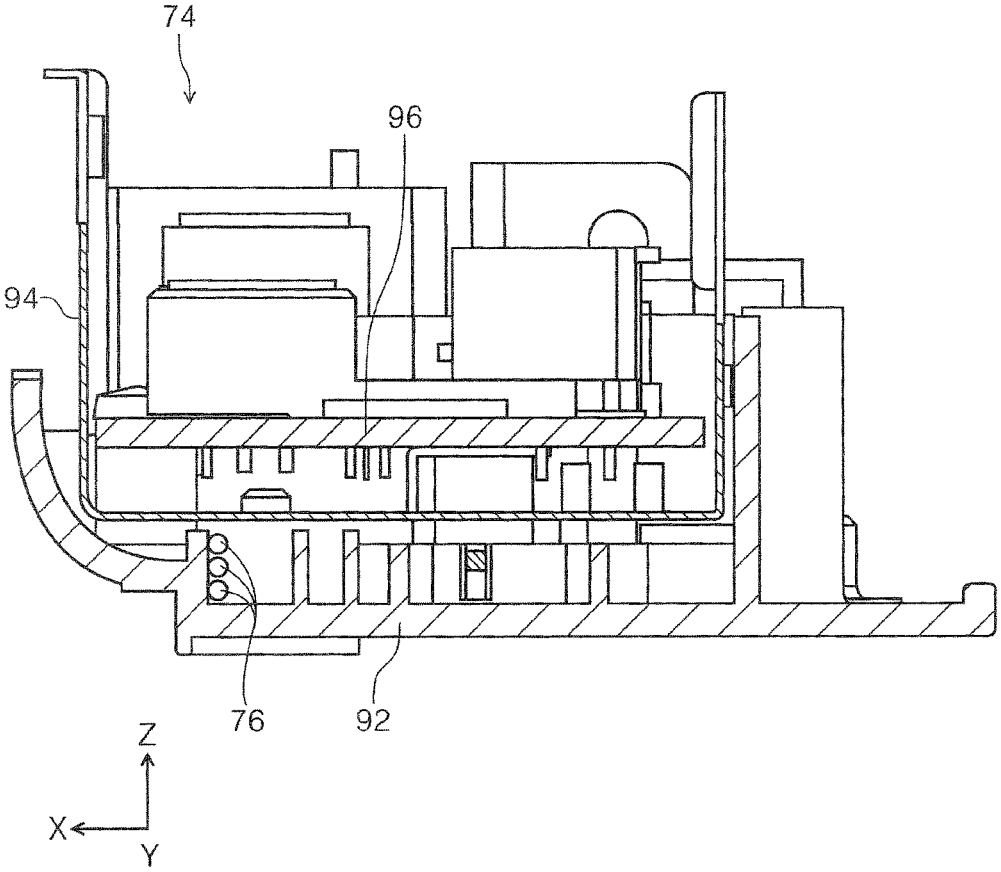
FIG. 19 is a sectional view which shows a relation between the control unit and the cable.

Further, FIG. 13 is a perspective view which shows a path of a cable extending from the power supply unit to an inlet in the printer according to the present invention, FIG. 14 is a sectional view which shows a relation between the cable extending from the power supply unit to the inlet and a cap, FIG. 15 is a perspective view which shows a relation among the cap, the inlet and the cable, FIG. 16 is a perspective view which shows a path of the cable from the power supply unit to a control unit, FIG. 17 is a perspective view of the control unit, FIG. 18 is a perspective view of the control unit, and FIG. 19 is a sectional view which shows a relation between the control unit and the cable.

Further, in the X-Y-Z coordinate system in the drawings, the X direction represents a main scan direction (movement direction) of the carriage, that is, a width direction of the recording apparatus, the Y direction represents a depth direction of the recording apparatus, and the Z direction represents a height direction of the recording apparatus. Throughout the drawings, +X direction represents the apparatus left side, −X direction represents the apparatus right side, −Y direction represents the apparatus front side, +Y direction represents the apparatus back side, +Z direction represents the apparatus upper side, and −Z direction represents the apparatus lower side.

Embodiment

Overview of Printer

Referring to FIG. 1, a printer 10 includes an apparatus main body 12 and a scanner section 14 disposed on the apparatus main body 12. An operation section 16 is provided on the apparatus front side of the apparatus main body 12 so as to be rotatable to the apparatus main body 12. The operation section 16 is provided with a display unit 18 such as a display panel. In the present embodiment, the operation section 16 can be switched between a state in which it is closed to the apparatus main body 12 (see FIG. 1) and a state in which it has been rotated toward the apparatus front side of the apparatus main body 12 and is open (see FIG. 2).

On the apparatus front side of the apparatus main body 12, a cover 20 is mounted on the lower side of the operation section 16 so as to be rotatable with respect to a medium container 28, which will be described below. Further, an output tray 22 is mounted on the apparatus main body 12. The output tray 22 can be switched between a state in which it is housed in the apparatus main body 12 and a state in which it is pulled out from the apparatus front side of the apparatus main body 12 (see FIG. 2).

Further, a cover 24 is rotatably mounted on the upper part of the back side of the apparatus main body 12. The cover 24 can be switched between a state in which it is closed to the apparatus main body 12 as shown in FIG. 1 and a state in which it is opened from the apparatus main body 12 (not shown in the figure). When the cover 24 is open from the apparatus main body 12, a medium can be inserted into the apparatus main body 12 in a direction indicated by the arrow A so that the inserted medium is guided by an inclined medium guiding path 26 shown in FIG. 2 to the downstream side in a transfer direction.

Then, referring to FIG. 2, a medium container 28 that houses a medium is disposed in the lower part of the apparatus main body 12. In the present embodiment, the medium container 28 is mounted on the apparatus main body 12 to be detachable from the apparatus front side of the apparatus main body 12. Further, the bold solid line designated by reference sign P indicates a guide path for a medium which is transported along a medium transportation path 29 from the medium container 28 to the output tray 22.

In the present embodiment, the apparatus main body 12 includes a pick up roller 30, a reversing roller 32, driven rollers 34*a*, 34*b* and 34*c*, a transportation roller pair 36, a recording unit 38 and an output roller pair 40, which are disposed in this order along the medium transportation path 29. The pick-up roller 30 is disposed on the upper side of the medium container 28 so as to be rotatable about a rotation shaft 37. When fed out from the medium container 28 by the pick-up roller 30, a medium is transported to the transportation roller pair 36 while being nipped between the reversing roller 32 and the driven rollers 34*a* and 34*b*.

The transportation roller pair 36 transports a medium to the recording unit 38. The recording unit 38 in the present embodiment includes a carriage 42, a recording head 44, and a medium guiding member 46. The carriage 42 in the present embodiment is configured to reciprocate in an apparatus width direction. The recording head 44 is disposed in the lower part of the carriage 42. The recording head 44 in the present embodiment is configured to eject ink, which is "liquid," downward in an apparatus height direction.

Further, the medium guiding member 46 is disposed in the region which faces the recording head 44 under the recording head 44. The medium guiding member 46 is disposed to face the recording head 44 while being spaced from the recording head 44. The medium guiding member 46 supports an underside of the medium (surface opposite from the recording surface) which has been transported to the region which faces the recording head 44 by the transportation roller pair 36. The recording head 44 performs recording on a recording surface of the medium by ejecting ink onto the medium supported by the medium guiding member 46.

After the recording is performed, the medium is nipped by the output roller pair 40 disposed downstream the recording unit 38 in the transfer direction and is outputted onto the output tray 22 that protrudes from the apparatus front side.

Further, the medium inserted from above the printer 10 though the opened cover 24 is guided by the medium guiding path 26 and transported to the recording unit 38, where recording is performed. After recording is performed, the medium is outputted onto the output tray 22.

Moreover, in the case where the recording unit 38 performs recording on a first surface (recording surface) of the medium and then on a second surface (underside), which is opposite from a first surface, the medium is transported upstream in the transfer direction by reversing the transportation roller pair 36. The medium transported upstream in the transfer direction is nipped between the reversing roller 32 and the driven roller 34*c*. Then, the first surface and the second surface of the medium are reversed by the reversing roller 32, and the medium is again transported to the recording unit 38, where recording is performed on the second surface. After that, the medium is outputted onto the output tray 22.

Layout of Components in Apparatus Main Body

Referring to FIGS. 3 through 8, components in the apparatus main body 12 and layout thereof in the apparatus main body 12 will be described. First, referring to FIGS. 3 to 6, a movement area B (FIG. 6) of the carriage 42 will be described. In the present embodiment, the carriage 42 includes a box-shaped casing 42*a* which is open upward in the apparatus height direction, and a bearing unit 42*b* (see FIG. 6) disposed on the back side of the casing 42*a*. On the casing 42*a*, a plurality of ink cartridges 48 is detachably mounted. When mounted on the carriage 42, the plurality of ink cartridges 48 in the present embodiment is arranged in the apparatus depth direction.

Further, a guide shaft 50 extends in the apparatus width direction on the back side of the carriage 42 in the apparatus depth direction. The guide shaft 50 is inserted in the bearing unit 42*b* of the carriage 42. The guide shaft 50 guides the carriage 42 moving in the apparatus width direction. In the present embodiment, a home position of the carriage 42 is defined by a position of the carriage 42 in the apparatus main body 12 on the right end in the apparatus width direction (see FIGS. 4 and 5). Furthermore, in the present embodiment, the movement area B of the carriage 42 (a region surrounded by the double dotted line indicated by the reference sign B in FIGS. 6 and 8) is defined by a region from the home position of the carriage 42 to the left end in the apparatus width direction. Moreover, a range indicated by the arrow C in the apparatus width direction represents a passing area of the medium passing through the recording unit 38.

Referring to FIGS. 3 and 6, a cap 52 is provided at the home position of the carriage 42. The cap 52 is configured to face the recording head 44 and is pressed against the nozzle forming surface (not shown in the figure) of the recording head 44 when the carriage 42 is located at the home position so as to seal the nozzle forming surface and prevent drying of ink.

The cap 52 in the present embodiment is disposed within the movement area B of the carriage 42 on the lower side in the apparatus height direction of the carriage 42 (see FIGS. 7 and 8). Further, in the present embodiment, a pump 54 (see FIG. 15) is disposed on the back side of the cap 52 in the apparatus depth direction. The cap 52 and the pump 54 in the present embodiment form an ink system 56, which serves as a "liquid flow path."

In the present embodiment, when the pump 54 is activated while the cap 52 seals the recording head 44, a negative pressure is generated in the cap 52 via a waste ink tube 58 (see FIG. 15) that connects the cap 52 and the pump 54. This negative pressure allows the ink to be suctioned through the nozzles of the recording head 44, thereby preventing clogging of the nozzles or contamination of air bubbles.

During the recording operation by the printer 10, a flushing operation is performed with a certain timing. The flushing operation is an operation of discharging ink toward the cap 52 after the carriage 42 is temporarily moved to the home position.

The waste ink, which is the "liquid," generated in the cap 52 is suctioned by the pump 54 through the waste ink tube 58. Then, the suctioned waste ink is supplied to a waste ink storing unit 62, which serves as a "liquid storage" (see FIG. 7) through the waste ink tube 60 which extends from the pump 54.

Referring to FIGS. 6 to 8, the ink system 56 (a region surrounded by the dotted line indicated by reference numeral 56 in FIG. 6) and the waste ink storing unit 62 (a region surrounded by the dotted line indicated by reference numeral 62 in FIG. 6) are disposed in the apparatus main body 12 on the right end in the apparatus width direction. Further, the waste ink storing unit 62 is disposed on the front side of the ink system 56 in the apparatus depth direction. Referring to FIG. 8, the ink system 56 and the waste ink storing unit 62 are disposed on the lower side of the carriage 42 in the apparatus height direction.

Further, in the present embodiment, an inlet 64 (see FIG. 7) is disposed on the back side of the ink system 56 in the apparatus depth direction. The inlet 64 is connected to a power supply plug 66 (see FIG. 7) that supplies power to the printer 10 from the outside of the printer 10. As shown in FIGS. 6 and 8, the waste ink storing unit 62, the ink system 56 and the inlet 64 are disposed in the apparatus main body 12 on the right end in the apparatus width direction and arranged in this order from the front side to the back side in the apparatus depth direction.

Referring again to FIG. 3, a cover 68 is disposed between the movement area B of the carriage 42 and the operation section 16 in the apparatus depth direction. As shown in FIG. 4, a power supply unit 70 is exposed when the cover 68 is removed from the apparatus main body 12. Referring to FIGS. 5 to 8, the power supply unit 70 in the present embodiment is disposed between the movement area B of the carriage 42 and the operation section 16 in the apparatus depth direction. The power supply unit 70 is disposed within the movement area B of the carriage 42 in the apparatus width direction. In the present embodiment, since the power supply unit 70 is disposed between the movement area B of the carriage 42 and the operation section 16, the printer 10 can be reduced in the apparatus size in the apparatus width direction.

The power supply unit 70 is disposed on the upper side of a passing area C of the medium in the printer 10, that is, the medium transportation path 29 in the apparatus height direction. In the present embodiment, as shown in FIGS. 7 and 8, the power supply unit 70 is disposed on the upper side of the recording head 44 of the carriage 42, the ink system 56 having the cap 52 and the pump 54, the waste ink storing unit 62 and the waste ink tubes 58 and 60 in the apparatus height direction.

Further, as shown in FIGS. 7 and 8, at least a portion of the power supply unit 70 in the present embodiment is disposed to overlap the region in which the carriage 42 is disposed, that is, the movement area B of the carriage 42 in the apparatus height direction. As described later, the power supply unit 70 and the inlet 64 are electrically connected via a cable 72 (see FIG. 7).

Further, referring to FIG. 6, a control unit 74 in the present embodiment is disposed in the apparatus main body 12 on the left end in the apparatus width direction so as to extend in the apparatus depth direction across the movement area B of the carriage 42. The control unit 74 is connected to the power supply unit 70 via the cable 76 (see FIGS. 16 to 18) so that power is supplied from the power supply unit 70. The control unit 74 will be further described later.

The power supply unit 70 is configured to supply power to drive targets such as the scanner section 14, carriage 42, pick up roller 30, reversing roller 32, transportation roller pair 36 and the output roller pair 40 in the printer 10. For example, referring to FIG. 5, the power supply unit 70 supplies power to a plurality of drive motors 98 in the apparatus main body 12 in response to control of the control unit 74.

Power Supply Unit

Referring to FIGS. 9 to 12, the power supply unit 70 will be described. In the present embodiment, the power supply unit 70 includes a circuit substrate 78, a lower housing 80 and an upper housing 82. The circuit substrate 78 includes a plurality of electronics. In the present embodiment, the circuit substrate 78 includes a power supply circuit that performs current conversion from AC to DC or rectification. Further, as shown in FIGS. 10 and 11, the circuit substrate 78 is mounted in the lower housing 80. In the present embodiment, the lower housing 80 and the upper housing 82 are formed by bending a metal material, for example, by a bending operation such as press working.

Specifically, the lower housing 80 is formed in a box shape that is open in the +Y axis direction in FIG. 10. In the lower housing 80, the circuit substrate 78 is disposed. Further, as shown in FIG. 11, claws 80*a* are provided at three positions on the lower housing 80 on the end in +Z axis direction. The claws 80*a* catch and hold the end of the circuit substrate 78 in +Z axis direction. As shown in FIG. 10, the end of the circuit substrate 78 in −Z axis direction is fixed to the lower housing 80 via the screw 84.

In the present embodiment, since the circuit substrate 78 is held by the screw 84 on one side and by the claws 80*a* on the other side, the number of screw holes formed on the circuit substrate 78 can be reduced, thereby reducing the power supply substrate in size.

As shown in FIG. 12, the upper housing 82 is also formed in a box shape that is open in the +Y axis direction. The lower housing 80 on which the circuit substrate 78 is mounted is housed in the box-shaped upper housing 82. That is, the circuit substrate 78 is housed in a box formed by the lower housing 80 and the upper housing 82. In other words, since the circuit substrate 78 is disposed in the box, few or no ink mist is attached on the circuit substrate 78 when ejected from the recording head 44 and suspending inside the apparatus main body 12.

Referring to FIG. 9, the power supply unit 70 in the present embodiment is disposed on the frame member 86. The frame member 86 is disposed between the movement area B of the carriage 42 and the operation section 16 in the apparatus depth direction and extends in the apparatus width direction. A front end 86*a* and a rear end 86*b* of the frame member 86 in the apparatus depth direction are bent upward in the apparatus height direction and extend upward in the apparatus height direction. The power supply unit 70 in the present embodiment is disposed between the front end 86*a* and the rear end 86*b* of the frame member 86 that extend upward in the apparatus height direction.

The cover 68 covers above the power supply unit 70 and the frame member 86. A wall 68*a* that protrudes downward in the apparatus height direction is disposed on the rear end of the cover 68. When the cover 68 covers the power supply unit 70 and the frame member 86, the rear end 86*b* of the frame member 86 and the wall 68*a* overlap in the apparatus height direction as seen in side view in the apparatus width direction.

The overlapped portion is disposed on the back side in the apparatus depth direction, that is, on the side close to the movement area B of the carriage 42. Accordingly, since the overlapped portion is disposed on the side close to the recording head 44, that is, the side where ink is ejected from the recording head 44, few or no ink mist enters the frame member 86, and thus the power supply unit 70.

Wiring of Cable from Power Supply Unit to Inlet

Next, referring to FIGS. 7 and 13 to 15, a wiring of the cable 72 extending from the power supply unit 70 to the inlet 64 will be described. Referring to FIGS. 7 and 13, one end of the cable 72 is mounted on the power supply unit 70. The cable 72 extending from the power supply unit 70 runs on the right side of the waste ink storing unit 62 in the apparatus width direction to the lower side in the apparatus height direction. Then, the cable 72 is turned at the lower end of the apparatus main body 12 toward the back side in the apparatus depth direction and extends to the inlet 64 which is disposed on the back side of the apparatus.

More specifically, as shown in FIGS. 13 and 15, a first base member 88 is disposed on the lower side of the apparatus main body 12 on the right end in the apparatus width direction. In the present embodiment, the waste ink storing unit 62 is detachably mounted on the first base member 88 on the front side in the apparatus depth direction. As shown in FIG. 14, a wall 88*b* is disposed on the right end of the first base member 88 in the apparatus width direction so as to upwardly extend from a bottom 88*a* in the apparatus height direction. An eaves shaped portion 88*c* is formed to protrude from the wall 88*b* to the right in the apparatus width direction. The eaves shaped portion 88*c* in the present embodiment extends along the wall 88*b* in the apparatus depth direction.

In the present embodiment, the cable 72 which extends downward from the power supply unit 70 in the apparatus height direction is turned when reaching under the eaves shaped portion 88*c*, and extends to the apparatus back side along the wall 88*b* under the eaves shaped portion 88*c*. Then, the cable 72 is turned at a position before the inlet 64 in the apparatus depth direction so as to extend from the lower side to the upper side of the eaves shaped portion 88*c*, and is then turned again so as to extend to the apparatus back side and connected to the inlet 64.

Referring to FIGS. 13 to 15, the wall 88*b* and the eaves shaped portion 88*c* are disposed between the ink system 56 and at least a portion of the cable 72, more specifically, a portion extending along the wall 88*b* in the apparatus main body 12. That is, the cable 72 is covered by the wall 88*b* and the eaves shaped portion 88*c*.

Further, referring to FIG. 15, the first base member 88 includes a plurality of openings 90 between the pump 54 and the inlet 64 in the apparatus depth direction. The opening port 90 communicates inside and outside the apparatus main body 12. When ink leaks from the ink system 56 or the waste ink storing unit 62, the opening port 90 allows the leaked ink to be discharged from inside the apparatus main body 12 to outside the apparatus main body 12.

Control Unit

Next, referring to FIGS. 16 to 19, the control unit 74 will be described. In the present embodiment, as shown in FIG. 16, the control unit 74 extends in the apparatus depth direction on the left end in the apparatus width direction. The control unit 74 in the present embodiment includes a second base member 92, a frame member 94 and a circuit substrate 96.

Referring to FIG. 19, the frame member 94 is mounted on the upper part of the second base member 92. In the present embodiment, the frame member 94 is formed by bending a metal material by a bending operation such as press working. The frame member 94 in the present embodiment has both ends in the apparatus width direction bent upward in the apparatus height direction. The circuit substrate 96 is mounted between both ends of the frame member 94 in the apparatus width direction. That is, the second base member 92, the frame member 94 and the circuit substrate 96 are arranged in this order from the lower side in the apparatus height direction.

In the present embodiment, the circuit substrate 96 is configured as an electric circuit having a plurality of electronics. In the present embodiment, the control unit 74 is configured to control an operation of the scanner section 14, a recording operation of the carriage 42, drive targets such as the pick-up roller 30, reversing roller 32, transportation roller pair 36 and output roller pair 40 in the printer 10.

Wiring of Cable from Power Supply Unit to Control Unit

Referring to FIG. 16, the cable 76 extending from the power supply unit 70 runs to the left end in the apparatus width direction. Then, the cable 76 is turned to the lower side in the apparatus height direction and extends to the lower side of the apparatus main body 12. The cable 76 enters under the frame member 94 shown in FIG. 17. In the present embodiment, an adaptor (not shown in the figure) is provided on the side of the power supply unit 70 on which the cable 76 is mounted. The adaptor (not shown in the figure) is detachably connected to a connector disposed on an end of the cable 76.

More specifically, as shown in FIGS. 17 and 18, the cable 76 enters between the frame member 94 and the second base member 92 in the apparatus height direction on the front end of the control unit 74 in the apparatus depth direction. As shown in FIGS. 17 and 19, the cable 76 extends between the frame member 94 and the second base member 92 to the back side in the apparatus depth direction. Then, the cable 76 on the back side in the apparatus depth direction extends across the control unit 74 in the apparatus width direction, that is, from the left end to the right end of the control unit 74 in the apparatus width direction. Further, the dotted line in FIGS. 17 and 18 indicates the wiring of the cable 76 on the lower side of the frame member 94.

The cable 76 which has extended across the control unit 74 on the back side in the apparatus depth direction is led out from under the frame member 94 in the apparatus height direction to above the circuit substrate 96. Then, the cable 76 is connected via a connector to an adaptor section 96*a* which is disposed on the back side of the circuit substrate 96 in the apparatus depth direction.

In the present embodiment, since the cable 76 is disposed to extend under the circuit substrate 96, the cable 76 can be prevented from being in contact with a plurality of electronics disposed on the circuit substrate 96. Further, the cable 76 can be prevented from being in contact with the circuit substrate 96, and a predetermined distance can be ensured between the cable 76 and the circuit substrate 96. Accordingly, electric properties of the control unit 74 can be stabilized.

Modified Examples of Embodiment (1) In the present embodiment, the cable 72 is configured to be led out from the power supply unit 70. However, instead of this configuration, the cable 72 and the power supply unit 70 may be connected via a connector. With this configuration, the connector of the cables 72 and 76 can be removed from the power supply unit 70 to facilitate attachment and detachment of the power supply unit 70 to and from the apparatus main body 12, thereby improving working efficiency in replacement of the power supply unit 70. (2) In the present embodiment, the scanner section 14 is disposed in the upper part of the apparatus main body 12. However, instead of this configuration, a cover can be provided in the upper part of the apparatus main body 12 so that the cover can be switched between a state in which it is open and exposes the upper part of the apparatus main body 12 and a state in which it is closed and covers the upper part of the apparatus main body 12.

In concluding the above description, the printer 10 includes the carriage 42 that is provided with the recording head 44 which performs recording on a medium and is movable in the apparatus width direction, which is a predetermined direction, and the power supply unit 70 that supplies power for driving drive targets including the carriage 42, that is, the scanner section 14, pick up roller 30, reversing roller 32, transportation roller pair 36, output roller pair 40 and the drive motor 98, and the position of the power supply unit 70 in the apparatus width direction, which is the movement direction of the carriage 42, is within the movement area B of the carriage 42.

With this configuration, since the position of the power supply unit 70 that supplies power for driving drive targets including the carriage 42, that is, the scanner section 14, pick up roller 30, reversing roller 32, transportation roller pair 36, output roller pair 40 and the drive motor 98 in the apparatus width direction, which is the movement direction of the carriage 42, is within the movement area B of the carriage 42, the apparatus dimension in the apparatus width direction, which is the movement direction of the carriage 42, can be reduced.

The power supply unit 70 is disposed on the front side in the apparatus with respect to the movement area B of the carriage 42 in the apparatus depth direction which intersects the apparatus width direction, which is the movement direction of the carriage 42. With this configuration, a space on the front side in the apparatus with respect to the movement area B of the carriage 42 can be effectively used, thereby reducing the apparatus depth dimension.

The power supply unit 70 is disposed above the medium transportation path 29, that is, the passing area C of a medium in the vertical direction. With this configuration, a region above the medium transportation path 29, which is likely to form a large vacant space, can be effectively used, thereby reducing the apparatus dimension in the vertical direction. In addition, a maintenance operation of the power supply unit 70 can be easily performed.

At least a portion of the power supply unit 70 overlaps the movement area B of the carriage 42 in the vertical direction. With this configuration, an installation space of the carriage 42 and an installation space of the power supply unit 70 are not completely superposed in the vertical direction, thereby reducing the apparatus dimension in the vertical direction.

The printer 10 includes the operation section 16 for an input operation on the apparatus front side in the apparatus depth direction that intersects the apparatus width direction, which is the movement direction of the carriage, and the power supply unit 70 is disposed between the movement area B of the carriage 42 and the operation section 16 in the apparatus depth direction.

With this configuration, since the operation section 16 for an input operation is disposed on the apparatus front side in the apparatus depth direction that intersects the apparatus width direction, which is the movement direction of the carriage 42, and the power supply unit 70 is disposed between the movement area B of the carriage 42 and the operation section 16 in the apparatus depth direction. Accordingly, a space between the operation section 16 and the movement area B can be effectively used, thereby reducing the apparatus depth dimension.

The printer 10 includes the cap 52 that seals the recording head 44 and the ink system 56 that guides ink, which is ejected into the cap 52 from the recording head 44, to the waste ink storing unit 62, and the power supply unit 70 is disposed above the ink system 56 in the vertical direction.

The printer 10 includes the inlet 64 for connecting the power supply plug 66 on the apparatus back side in the apparatus depth direction that intersects the apparatus width direction, which is the movement direction of the carriage 42, and at least a portion of the cable 72 that connects the inlet 64 and the power supply unit 70 is disposed with the wall **88*b* between the at least a portion of the cable 72 and at least a portion of the ink system 56**.

In the printer 10, the rear end **86*b* of the frame member 86 and the wall 68*a* are disposed between the power supply unit 70 and the movement area B of the carriage 42**.

The printer 10 includes the carriage 42 that is provided with the recording head 44 which performs recording on a medium and is movable in the apparatus width direction, which is a predetermined direction, and the power supply unit 70 that supplies power for driving drive targets including the carriage 42, that is, the scanner section 14, pick up roller 30, reversing roller 32, transportation roller pair 36, output roller pair 40 and the drive motor 98, and the power supply unit 70 is disposed on the apparatus front side with respect to the movement area B of the carriage 42 in the apparatus depth direction which intersects the apparatus width direction, which is the movement direction of the carriage 42. With this configuration, a space on the front side in the apparatus with respect to the movement area B of the carriage 42 can be effectively used, thereby reducing the apparatus depth dimension.

The printer 10 includes the recording head 44 which performs recording on a medium and the power supply unit 70 that supplies power for driving drive targets including the recording head 44, that is, the scanner section 14, pick up roller 30, reversing roller 32, transportation roller pair 36, output roller pair 40 and the drive motor 98, and the power supply unit 70 is disposed above the medium transportation path 29, which is the passing area C of a medium, in the vertical direction. With this configuration, a region above the medium transportation path 29, which is likely to form a large vacant space, can be effectively used, thereby reducing the apparatus dimension in the vertical direction. In addition, a maintenance operation of the power supply unit 70 can be easily performed.

In the present embodiment, the power supply unit 70 according to the present invention is applied to the ink jet printer, which is an example of the recording apparatus. However, the power supply unit 70 can also be applied to other liquid ejecting apparatuses. The liquid ejecting apparatus described herein is not limited to recording apparatuses such as printers, copy machines and facsimile machines that use an ink jet recording head and perform recording by ejecting ink from the recording head onto a recording medium, but also includes apparatuses that eject liquid depending on the application instead of ink from a liquid ejecting head, which corresponds to the ink jet recording head, onto an ejection target medium, which corresponds to the recording medium, so that the liquid is attached onto the ejection target medium.

The liquid ejecting head may also include, in addition to the recording heads, color material ejecting heads used for producing color filters of liquid crystal displays or the like, electrode material (conductive paste) ejecting heads used for producing electrodes of organic EL displays, surface emission displays (FED) or the like, bioorganic ejecting heads used for producing biochips, and sample ejecting heads such as micro pipettes.

It should be noted that the present invention is not limited to the above embodiments. Regardless to say, various modifications are contemplated within the scope of the invention as defined in the appended claims, and these should be included in the scope of the present invention.

The entire disclosure of Japanese Patent Application No. 2016-035220, filed Feb. 26, 2016 is expressly incorporated by reference herein.

What is claimed is:

1. A recording apparatus comprising:

a carriage which includes a recording head that performs recording on a medium and is movable in a predetermined direction;

a power supply unit that supplies power for driving drive targets including the carriage, wherein the power supply unit is located at a position in a movement area of the carriage, the movement area corresponding to a movement direction of the carriage, which movement direction is the predetermined direction;

an inlet for connecting a power supply plug on an apparatus back side in an apparatus depth direction, which is a direction that intersects the movement direction of the carriage; and a power cable connecting the power supply unit to a power inlet, wherein the power cable crosses below the movement area in an apparatus height direction as seen in side view in an apparatus width direction.

2. The recording apparatus according to claim 1, wherein the power supply unit is disposed on an apparatus front side with respect to the movement area of the carriage in the apparatus depth direction, which is a direction intersecting the movement direction of the carriage.

3. The recording apparatus according to claim 1, wherein the power supply unit is disposed on an upper side of a transportation path of a medium in the apparatus height direction.

4. The recording apparatus according to claim 1, wherein at least a portion of the power supply unit overlaps the movement area of the carriage in the apparatus height direction.

5. The recording apparatus according to claim 1, further including an operation section for input operation disposed on the apparatus front side in the apparatus depth direction, which is a direction intersecting the movement direction of the carriage, wherein the power supply unit is disposed between the movement area of the carriage and the operation section in the apparatus depth direction.

6. The recording apparatus according to claim 1, further including:

a cap that seals the recording head; and a liquid flow path that guides liquid, which is ejected into the cap from the recording head, to a liquid storage, wherein the power supply unit is disposed on an upper side of the liquid flow path in the apparatus height direction.

7. The recording apparatus according to claim 6, further including:

wherein at least a portion of the power cable that connects the power inlet and the power supply unit is disposed with a wall interposed between the at least a portion of the power cable and at least a portion of the liquid flow path.

8. The recording apparatus according to claim 1, wherein a wall is disposed between the power supply unit and the movement area of the carriage.

9. A recording apparatus comprising:

a carriage which includes a recording head that performs recording on a medium and is movable in a predetermined direction;

a power supply unit that supplies power for driving drive targets including the carriage, wherein the power supply unit is located at an apparatus front side with respect to a movement area of the carriage in an apparatus depth direction, which is a direction intersecting a movement direction of the carriage;

an inlet for connecting a power supply plug on an apparatus back side in the apparatus depth direction; and a power cable connecting the power supply unit to a power inlet, wherein the power cable crosses below the movement area in an apparatus height direction as seen in side view in an apparatus width direction.

10. A recording apparatus comprising:

a recording head that performs recording on a medium;

a power supply unit that supplies power for driving drive targets including the recording head, wherein the power supply unit is located at an upper side of a transportation path of a medium in an apparatus height direction;

an inlet for connecting a power supply plug on an apparatus back side in an apparatus depth direction, which is a direction that intersects a movement direction of the recording head; and a power cable connecting the power supply unit to a power inlet, wherein the power cable crosses below the movement area in the apparatus height direction as seen in side view in an apparatus width direction.

11. The recording apparatus according to claim 1, wherein the power cable is located within a housing of the recording apparatus and extends along a majority of a length of at least one side of the recording apparatus.

12. A recording apparatus comprising:

a carriage which includes a recording head that performs recording on a medium and is movable in a predetermined direction; and a power supply unit that supplies power for driving drive targets including the carriage, wherein the power supply unit is disposed in a protective housing, and wherein an overlapping portion of the protective housing overlaps a movement area of the carriage such that the carriage moves underneath the overlapping portion of the protective housing, the movement area corresponding to a movement direction of the carriage, which movement direction is the predetermined direction.

13. A recording apparatus comprising:

a media container that houses a medium is disposed in a lower part of the recording apparatus;

a carriage which includes a recording head that performs recording on the medium fed out from the media container and is movable in a predetermined direction;

an output tray that outputs the recorded media;

a power supply unit that supplies power for driving drive targets including the carriage, wherein the power supply unit is located at a position in a movement area of the carriage, the movement area corresponding to a movement direction of the carriage, which movement direction is the predetermined direction; and an operation section for input operation disposed on an apparatus front side in an apparatus depth direction, which is a direction intersecting the movement direction of the carriage, wherein the power supply unit is disposed between the movement area of the carriage and the operation section in the apparatus depth direction and is disposed on or above the media container and the output tray in a height direction.

* * * * *